US012808592B2

(12) United States Patent
Long et al.

(10) Patent No.: US 12,808,592 B2
(45) Date of Patent: Nov. 24, 2026

(54) REFRIGERATOR AND CONTROL METHOD THEREFOR

(71) Applicant: HISENSE RONSHEN (GUANGDONG) REFRIGERATOR CO., LTD., Guangdong (CN)

(72) Inventors: Xiaofen Long, Foshan (CN); Huimin Yao, Foshan (CN); Yubo Lu, Foshan (CN); Zhongming Huang, Foshan (CN); Jinbo Gan, Foshan (CN)

(73) Assignee: HISENSE RONSHEN (GUANGDONG) REFRIGERATOR CO., LTD., Guangdong (CN)

( * ) Notice: Subject to any disclaimer, the term of this patent is extended or adjusted under 35 U.S.C. 154(b) by 71 days.

(21) Appl. No.: 18/970,862

(22) Filed: Dec. 5, 2024

(65) Prior Publication Data

US 2025/0093086 A1 Mar. 20, 2025

Related U.S. Application Data

(63) Continuation of application No. PCT/CN2023/104927, filed on Jun. 30, 2023.

(30) Foreign Application Priority Data

Jun. 30, 2022 (CN) ..... 202210759347.9
Sep. 16, 2022 (CN) ..... 202211126022.3

(51) Int. Cl.
*F25C 5/08* (2006.01)
*F25C 1/24* (2018.01)
*F25C 1/25* (2018.01)

(52) U.S. Cl.
CPC ..... *F25C 5/08* (2013.01); *F25C 1/24* (2013.01); *F25C 1/25* (2018.01); *F25C 2400/10* (2013.01)

(58) Field of Classification Search
CPC ..... F25C 5/08; F25C 1/24; F25C 1/25; F25C 2400/10; F25C 2700/04; F25C 5/22;
(Continued)

(56) References Cited

U.S. PATENT DOCUMENTS 3,327,651 A * 6/1967 Nielsen ..... A23G 9/285 425/588
6,349,550 B1 * 2/2002 Shapiro ..... F25C 1/10 62/233

(Continued)

FOREIGN PATENT DOCUMENTS

CN 201155897 11/2008
CN 103486812 1/2014

(Continued)

OTHER PUBLICATIONS

"International Search Report (Form PCT/ISA/210) of PCT/CN2023/104927," mailed on Sep. 25, 2023, with English translation thereof, pp. 1-8.

(Continued)

*Primary Examiner* — Eric S Ruppert
*Assistant Examiner* — Kirstin U Oswald
(74) *Attorney, Agent, or Firm* — JCIPRNET

(57) ABSTRACT

A refrigerator, includes an ice maker and a controller. The ice maker includes a mold shell, a driving mechanism and a demolding mechanism. The driving mechanism is configured to drive the mold shell to move. The demolding mechanism is configured to eject ice blocks from the mold shell when coming into contact with the mold shell. The controller is configured to: when the refrigerator is powered off, record an operation currently performed by the ice maker; when the refrigerator is powered back on, if the recorded operation is an ice making operation or a water injection operation, and a flow pulse of injected water is (Continued)

detected, determine that water may exist in a mold cavity, if the mold shell is closed, determine that water exists in the mold cavity; and if the mold shell is not closed, determine that no water exists in the mold cavity.

20 Claims, 15 Drawing Sheets

(58) Field of Classification Search
CPC ..... F25C 2600/04; F25C 1/04; F25C 1/10; F25D 29/00
USPC ..... 62/71
See application file for complete search history.

(56) References Cited

U.S. PATENT DOCUMENTS

| | | | | |
|---|---|---|---|---|
| 8,904,816 | B2 * | 12/2014 | Bergqvist | F25C 1/10 62/380 |
| 2005/0072166 | A1 | 4/2005 | Lee et al. | |
| 2013/0327074 | A1 * | 12/2013 | Lee | F25C 1/04 62/177 |
| 2014/0165610 | A1 * | 6/2014 | Boarman | F25C 1/00 62/3.63 |
| 2016/0216022 | A1 * | 7/2016 | Park | F25C 5/00 |
| 2021/0341201 | A1 | 11/2021 | Yeom et al. | |
| 2022/0260296 | A1 * | 8/2022 | Ji | G01F 23/26 |
| 2023/0243565 | A1 * | 8/2023 | Kim | F25C 1/25 62/139 |
| 2025/0093086 | A1 * | 3/2025 | Long | F25C 1/04 |

FOREIGN PATENT DOCUMENTS

| | | | | | |
|---|---|---|---|---|---|
| CN | 103851877 | | | 6/2014 | |
| CN | 110286747 | | | 9/2019 | |
| CN | 110906612 | | | 3/2020 | |
| CN | 110906640 | | | 3/2020 | |
| CN | 213040838 | | | 4/2021 | |
| CN | 113188286 | | | 7/2021 | |
| CN | 113237278 | A | * | 8/2021 | F25D 23/12 |
| CN | 113237279 | A | * | 8/2021 | F25C 1/22 |
| CN | 113237281 | A | * | 8/2021 | F25C 1/24 |
| CN | 113237282 | A | * | 8/2021 | F25C 5/08 |
| CN | 113237283 | | | 8/2021 | |
| CN | 113237283 | A | * | 8/2021 | F25C 1/24 |
| CN | 113237284 | | | 8/2021 | |
| CN | 113237284 | A | * | 8/2021 | F25C 5/08 |
| CN | 113237285 | A | * | 8/2021 | F25C 5/08 |
| CN | 215176405 | | | 12/2021 | |
| CN | 215176406 | U | * | 12/2021 | |
| CN | 216790597 | U | * | 6/2022 | |
| JP | 2005221099 | | | 8/2005 | |
| JP | 2008101809 | | | 5/2008 | |
| JP | 2011237080 | | | 11/2011 | |
| KR | 19990013143 | | | 2/1999 | |
| KR | 20210005498 | A | * | 1/2021 | F25C 5/187 |
| KR | 20210047095 | A | * | 4/2021 | F25C 1/00 |
| WO | 2015127718 | | | 9/2015 | |

OTHER PUBLICATIONS

"Written Opinion of the International Searching Authority (Form PCT/ISA/237) of PCT/CN2023/104927," mailed on Sep. 25, 2023, with English translation thereof, pp. 1-7.
"Notice of allowance of China Counterpart Application No. 202210759347.9", issued on Mar. 30, 2026, p. 1-p. 4.
"Office Action of China Counterpart Application No. 202211126022.3", issued on Apr. 15, 2026, p. 1-p. 7.
"Office Action of China Counterpart Application", issued on Aug. 31, 2026, p. 1-p. 6.

* cited by examiner

REFRIGERATOR AND CONTROL METHOD THEREFOR

CROSS-REFERENCE TO RELATED APPLICATION

The present application is a continuation application of PCT application No. PCT/CN2023/104927, filed Jun. 30, 2023, which claims priority to Chinese patent application No. 202210759347.9, filed on Jun. 30, 2022, and priority to Chinese patent application No. 202211126022.3, filed on Sep. 16, 2022, the entire contents of which are incorporated herein by reference.

TECHNICAL FIELD

The present disclosure relates to the field of ice making control technologies, and in particular, to a refrigerator and a control method therefor.

BACKGROUND

As consumers' demands for refrigerator functions continue to increase, refrigerators with ice making functions are becoming more and more popular among consumers.

A main structure for making ice in a refrigerator is an ice maker, which is usually located in an ice making chamber separated from the refrigerating compartment or freezing compartment. A basic principle of ice making includes: injecting water into the ice making compartment in the ice maker, supplying cold to the ice making chamber to freeze the water in the ice making compartment into ice blocks, and demolding the ice blocks from the ice making compartment into an ice storage box for users to take.

SUMMARY

In an aspect, a refrigerator is provided, including a refrigerator body, an ice maker and a controller. An ice making chamber is defined in the refrigerator body. The ice maker is disposed in the ice making chamber and includes a mold shell, a driving mechanism and a demolding mechanism. The mold shell includes a first sub-mold shell and a second sub-mold shell. The driving mechanism is configured to drive at least one of the first sub-mold shell or the second sub-mold shell to move. When the first sub-mold shell and the second sub-mold shell move to a closed state, the first sub-mold shell and the second sub-mold shell cooperatively define a mold cavity. The demolding mechanism is disposed on at least a side of the mold shell and is spaced apart from the mold shell by a predefined distance. The demolding mechanism is configured to eject an ice block in the mold shell when the demolding mechanism comes into contact with the mold shell. The controller is configured to: when the refrigerator is powered off, record an operation currently performed by the ice maker; when the refrigerator is powered back on, on a condition that the recorded operation of the ice maker is an ice making operation or the water injection operation, and a flow pulse of injected water is detected when the ice maker performs the water injection operation, determine that water may exist in the mold cavity; on a condition that the first sub-mold shell and the second sub-mold shell are in the closed state, determine that water exists in the mold cavity; and on a condition that the first sub-mold shell and the second sub-mold shell are not in the closed state, determine that no water exists in the mold cavity.

In another aspect, a control method for a refrigerator is provided, the refrigerator including a refrigerator body and an ice maker. An ice making chamber is defined in the refrigerator body. The ice maker is disposed in the ice making chamber and includes a mold shell, a driving mechanism and a demolding mechanism. The mold shell includes a first sub-mold shell and a second sub-mold shell. The driving mechanism is configured to drive at least one of the first sub-mold shell or the second sub-mold shell to move. When the first sub-mold shell and the second sub-mold shell move to a closed state, the first sub-mold shell and the second sub-mold shell cooperate to define a mold cavity. The demolding mechanism is disposed on at least a side of the mold shell and is spaced apart from the mold shell by a predefined distance. The demolding mechanism is configured to eject an ice block in the mold shell when the demolding mechanism comes into contact with the mold shell. The method includes: when the refrigerator is powered off, recording an operation currently performed by the ice maker; when the refrigerator is powered back on, on a condition that a recorded operation by the ice maker is the ice making operation or the water injection operation, and a flow pulse of injected water is detected when the ice maker performs the water injection operation, determining that water may exist in the mold cavity; on a condition that the first sub-mold shell and the second sub-mold shell are in the closed state, determining that water exists in the mold cavity; and on a condition that the first sub-mold shell and the second sub-mold shell are not in the closed state, determining that no water exists in the mold cavity.

In yet another aspect, a refrigerator is provided, which includes a refrigerator body, an ice maker and a controller. The refrigerator body includes an ice making chamber defined therein. The ice maker is disposed in the ice making chamber and includes a mold shell, a driving mechanism and a demolding mechanism. The mold shell includes a first sub-mold shell and a second sub-mold shell. The driving mechanism is configured to drive at least one of the first sub-mold shell or the second sub-mold shell to move, and the first and second sub-mold shells cooperatively define a mold cavity when the first and second sub-mold shells move to a closed state. The demolding mechanism is disposed on at least a side of the mold shell and spaced apart from the mold shell by a predefined distance, and is configured to eject an ice block in the mold shell when the demolding mechanism comes into contact the mold shell. The controller is configured to record an operation currently performed by the ice maker when the refrigerator is powered off, and when the refrigerator is powered back on, determine a water status of the mold cavity based on the recorded operation.

Details of one or more embodiments of the present disclosure are set forth in the following drawings and description. Other features, objectives, and advantages of the present disclosure will become apparent from the specification, drawings, and claims.

DETAILED DESCRIPTION OF THE INVENTION

Technical solutions in some embodiments of the present disclosure will be described clearly and completely below with reference to the accompanying drawings. However, the described embodiments are merely some but not all embodiments of the present disclosure. All other embodiments obtained by a person of ordinary skill in the art based on the embodiments of the present disclosure shall be included in the protection scope of the present disclosure.

Figure 1:
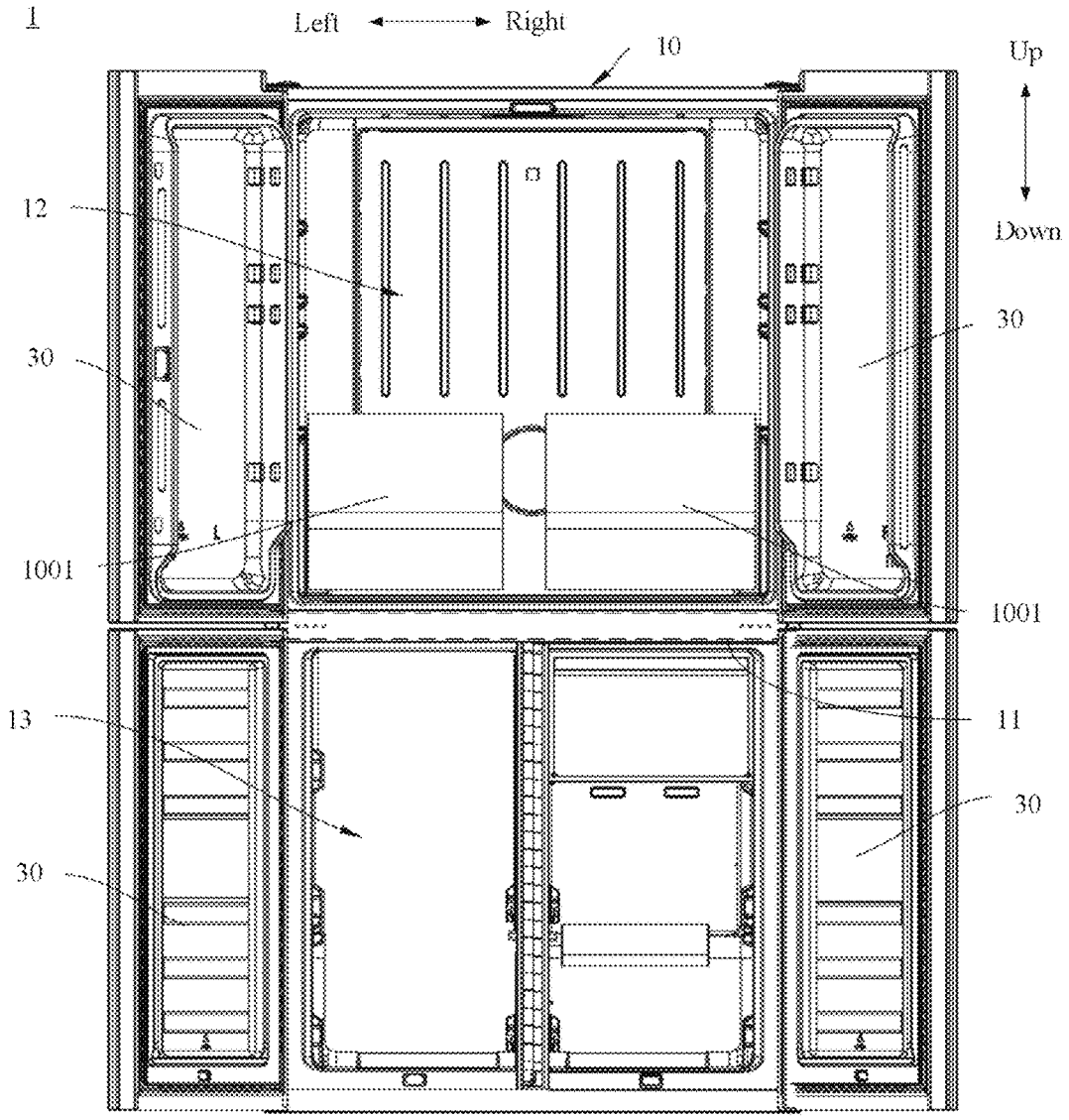
FIG. 1 is a diagram showing a structure of a refrigerator with a door body in an open state according to some embodiments.
Figure 2:
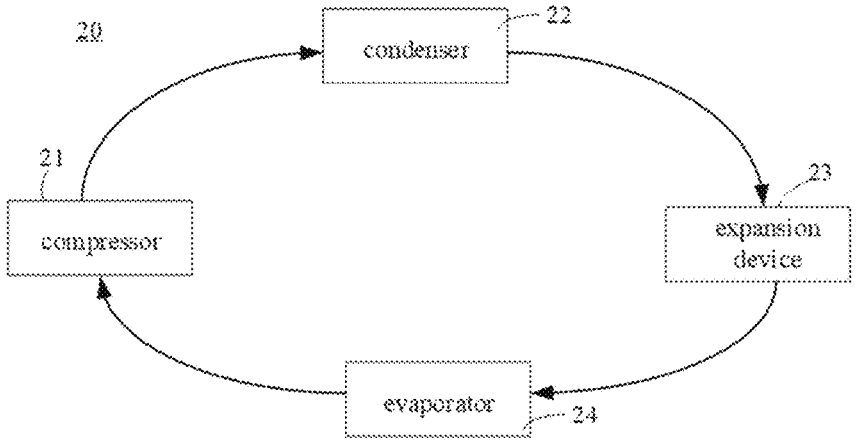
FIG. 2 is a schematic diagram of a cold air supply device of a refrigerator according to some embodiments.

A refrigerator 1 is provided in some embodiments of the present disclosure. As shown in FIG. 1 and FIG. 2, the refrigerator 1 includes a refrigerator body 10, a cold air supply device 20 and a door body 30. The refrigerator body 10 includes a storage compartment, and the cold air supply device 20 is disposed in the refrigerator body 10 and is configured to provide cold air to the storage compartment. The door body 30 is pivotally connected to the refrigerator body 10 and is configured to rotate relative to the door body 30 to open or close the storage compartment.

The refrigerator body 10 includes a transverse partition plate 11 disposed at the middle of the refrigerator body 10 along a height direction, where the height direction refers to an up-down direction in FIG. 1. The transverse partition plate 11 extends along a left-right direction in FIG. 1. An approximate position of the transverse partition plate 11 is shown by a dotted box in FIG. 1.

The storage compartment is divided into an upper storage compartment 12 and a lower storage compartment 13 by the transverse partition plate 11. In some embodiments, the upper storage compartment 12 is used as a freezing compartment for storing food in a freezing mode, and the lower storage compartment 13 is used as a refrigerating compartment for storing food in a refrigeration mode. In some embodiments, the upper storage compartment 12 is used as a refrigerating compartment for storing food in a refrigerated mode, and the lower storage compartment 13 is used as a freezing compartment for storing food in a freezing mode.

In some embodiments, as shown in FIG. 1, the refrigerator 1 includes four doors. The four doors 30 are located at a front end of the refrigerator body 10 and are hinged to the refrigerator body 10.

For example, two of the four doors 30 are disposed at a front end of the upper storage compartment 12, and are configured to rotate in directions away from each other to open the upper storage compartment 12, or rotate in directions toward each other to close the upper storage compartment 12. The other two of the four doors 30 are disposed at a front end of the lower storage compartment 13, and are configured to rotate in directions away from each other to open the lower storage compartment 13, or rotate in directions toward each other to close the lower storage compartment 13.

The cold air supply device 20 cools the storage compartment by performing heat exchange with an outside of the refrigerator body 10. As shown in FIG. 2, the cold air supply device 20 includes a compressor 21, a condenser 22, an expansion device 23, and an evaporator 24, and circulates a refrigerant in a sequence of the compressor 21, the condenser 22, the expansion device 23, the evaporator 24, and the compressor 21 to cool the storage compartment.

For example, the evaporator 24 may be arranged to be in contact with an outer wall of the storage compartment to directly cool the storage compartment. In some embodiments, the cold air supply device 20 may further include a circulation fan to circulate the air within the storage compartment through the evaporator 24 and the circulation fan.

In some embodiments, as shown in FIG. 1, the refrigerator 1 further includes an ice maker 1001, which is disposed in the storage compartment.

Figure 3:
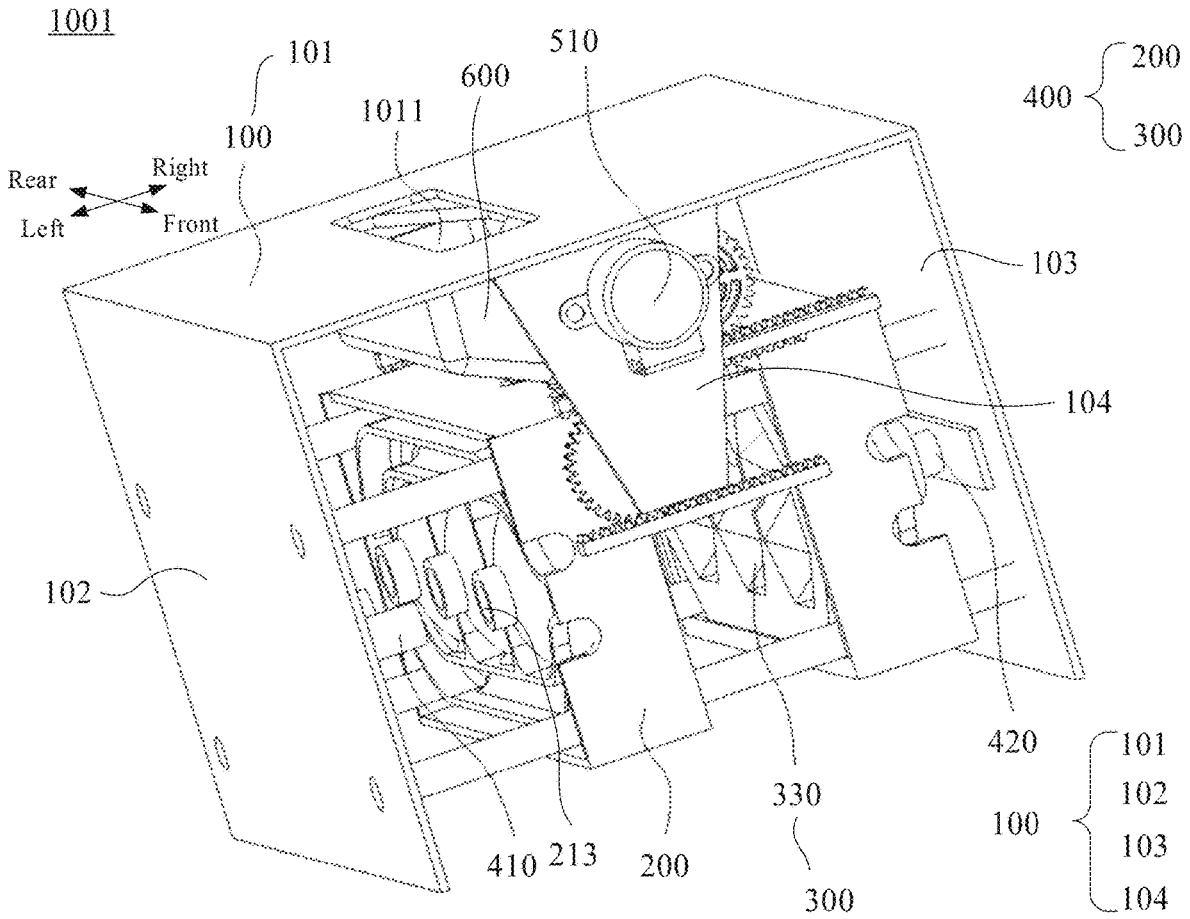
FIG. 3 is a perspective view of an ice maker of a refrigerator according to some embodiments.
Figure 4:
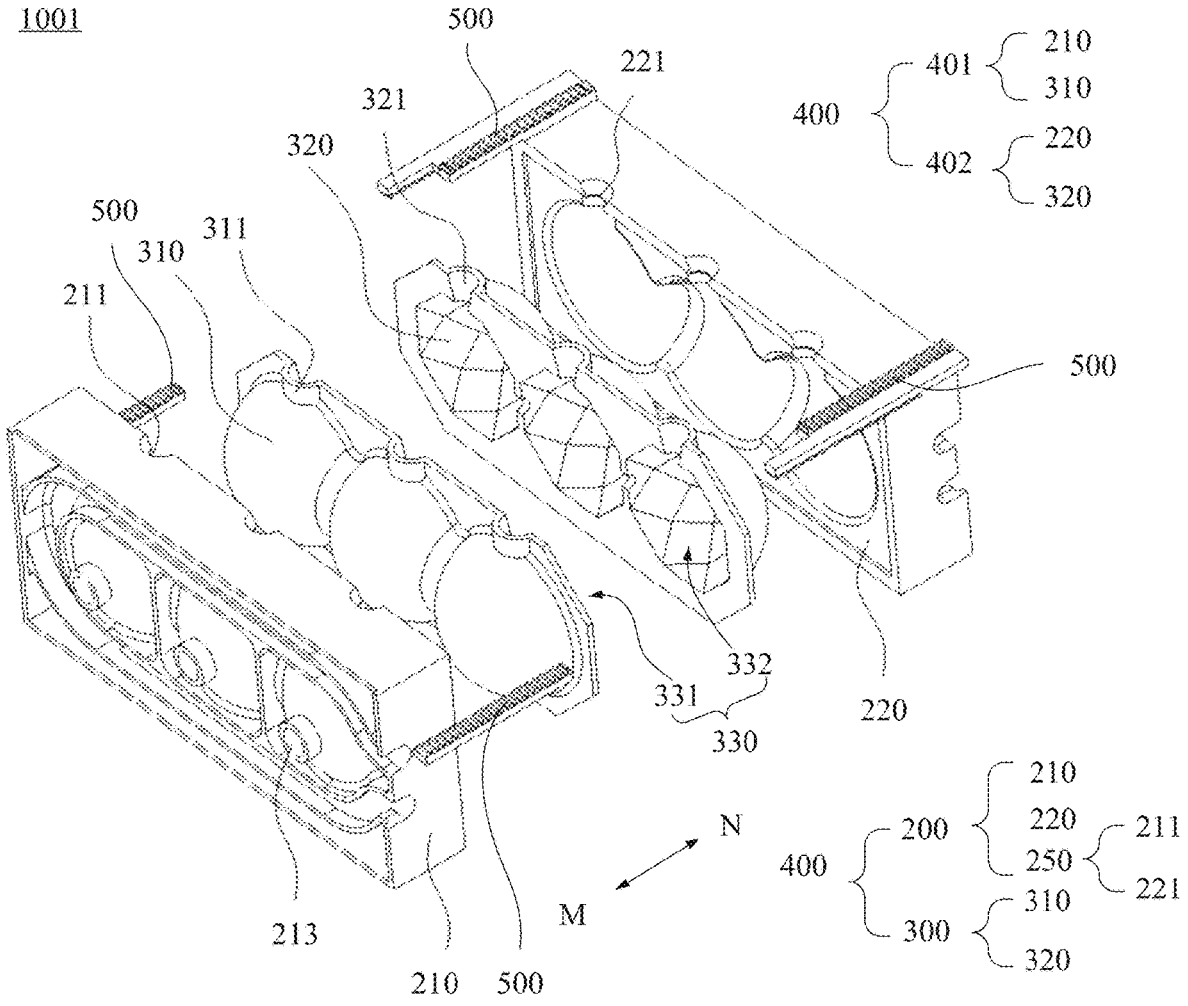
FIG. 4 is an exploded view of a mold shell and a driving mechanism of an ice maker of a refrigerator according to some embodiments.

For example, the storage compartment includes an ice making chamber, and the ice maker 1001 is disposed in the ice making chamber. For example, the ice maker 1001 is disposed in the upper storage compartment 12 (i.e., the freezing compartment), so that the upper storage compartment 12 can be used as the ice making chamber. Alternatively, a plurality of thermal insulation plates is disposed in the upper storage compartment 12 or the lower storage compartment 13, and the plurality of thermal insulation plates cooperate with each other to define the ice making chamber. The ice maker 1001 is configured to make ice so that the refrigerator 1 can provide ice blocks or ice water to the user. Referring to FIG. 3 and FIG. 4, the ice maker 1001 includes a base 100, a mold shell 400 (including a shell portion 200 and a mold portion 300), and a driving mechanism 500.

The base 100 is configured to be connected to the ice making chamber and includes a plurality of side plates. For example, the plurality of side plates includes an upper side plate 101, a left side plate 102, a right side plate 103, a front side plate 104, and a rear side plate. The left side plate 102 and the right side plate 103 are opposite to each other in a left-right direction shown in FIG. 3, the front side plate 104 and the rear side plate are opposite to each other in a front-rear direction shown in FIG. 3, and the upper side plate 101 is located on the top of the left side plate 102, the right side plate 103, the front side plate 104, and the rear side plate.

It should be noted that the up, front, rear, left and right directions mentioned in some embodiments of the present disclosure are defined for the purpose of clearly describing the structure. In actual settings, the base 100 is not limited to being disposed in the ice making chamber in the front-rear direction as shown in FIG. 3.

Figure 5:
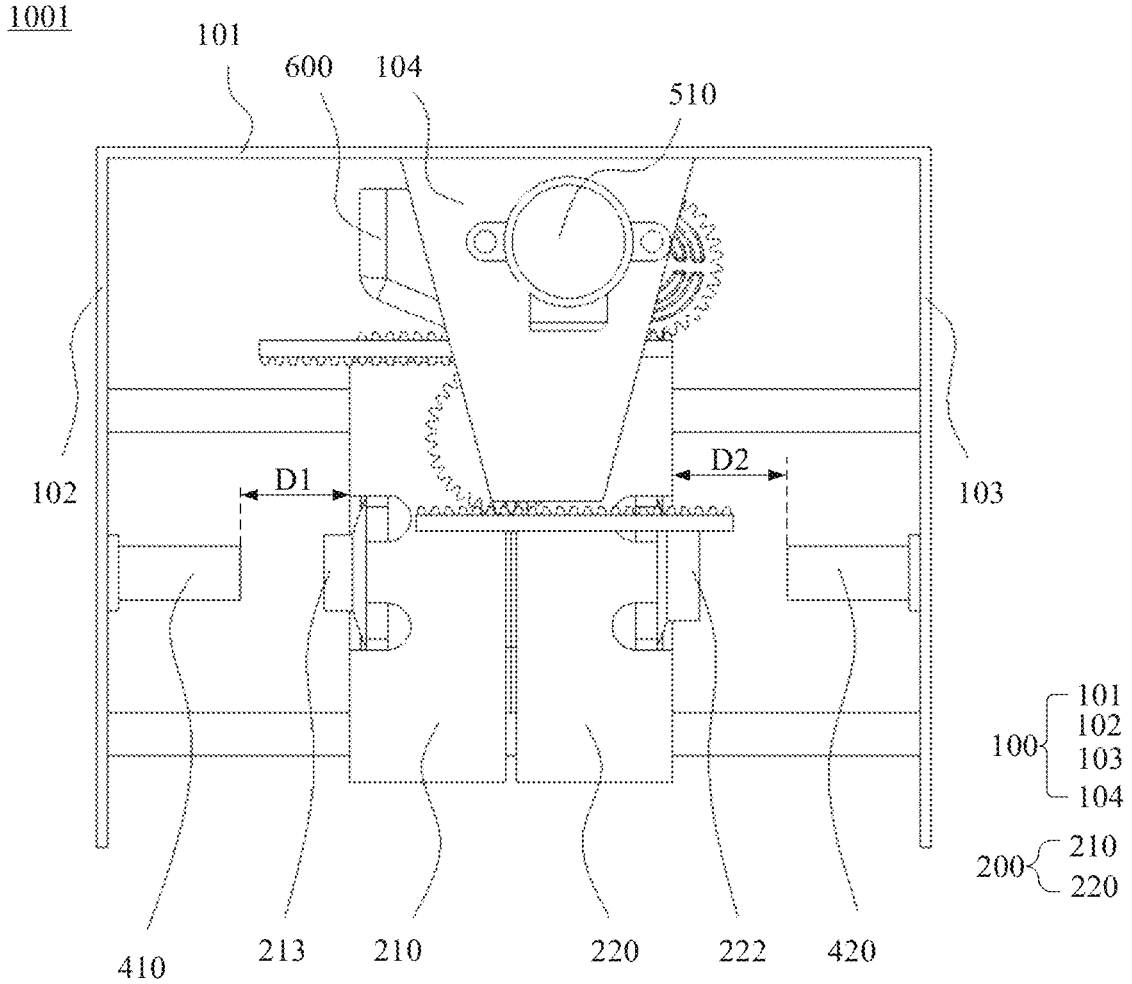
FIG. 5 is a diagram showing a structure of a first sub-mold shell and a second sub-mold shell of an ice maker of a refrigerator when they are in a closed state according to some embodiments.
Figure 6:
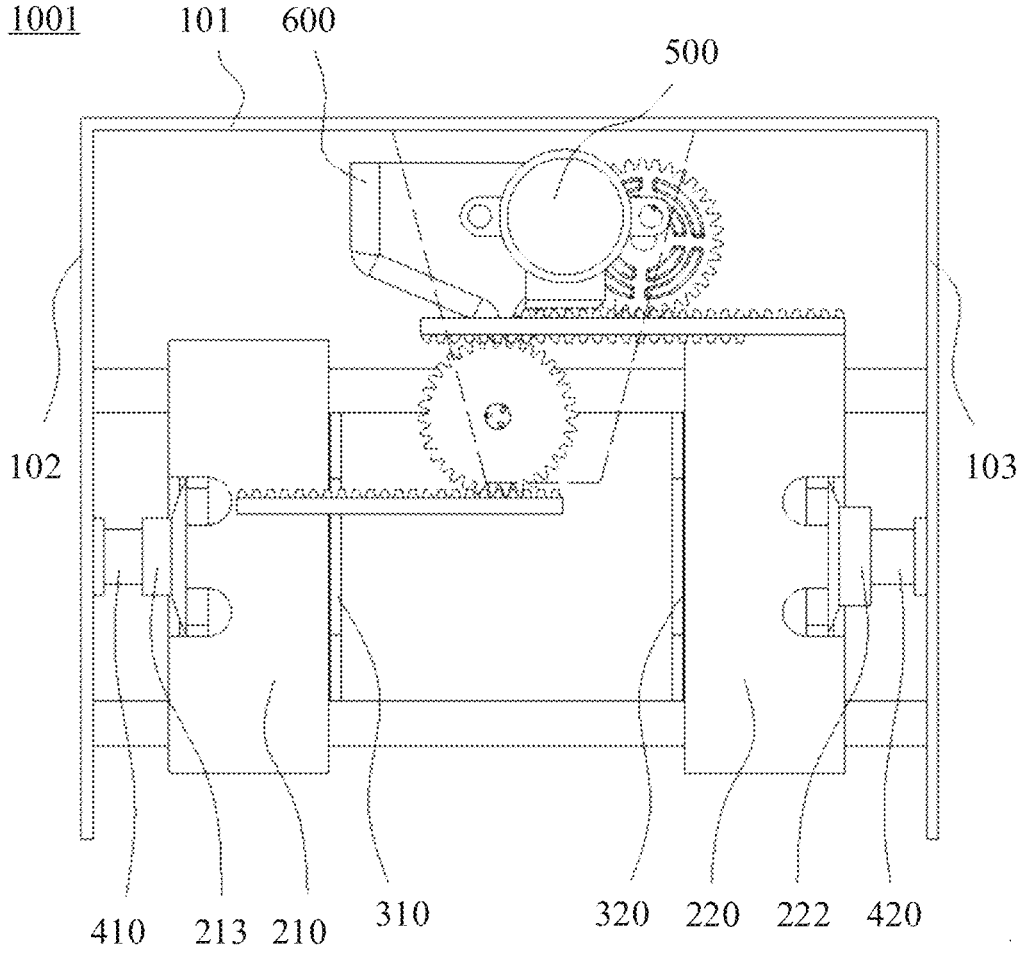
FIG. 6 is a diagram showing a structure of a first sub-mold shell and a second sub-mold shell of an ice maker of a refrigerator when they are in a separated state according to some embodiments.

In some embodiments, as shown in FIG. 3 and FIG. 4, the mold shell 400 includes a first sub-mold shell 401 and a second sub-mold shell 402, and the first sub-mold shell 401 and the second sub-mold shell 402 can be switched between a separated state (as shown in FIG. 6) and a closed state (as shown in FIG. 5). When the first sub-mold shell 401 and the second sub-mold shell 402 are in the closed state, the first sub-mold shell 401 and the second sub-mold shell 402 enclose a mold cavity 330, i.e., the first sub-mold shell 401 and the second sub-mold shell 402 cooperatively define the mold cavity 330 between the first sub-mold shell 401 and the second sub-mold shell 402. The shape of the mold cavity 330 is same as that of an ice block. It should be noted that the shape of the mold cavity 330 can be adaptively designed according to the needs of users, which is not limited in the present disclosure. For example, the mold cavity 330 can be designed to be spherical, diamond-faced spherical, or polyhedral.

In some embodiments, both the first sub-mold shell 401 and the second sub-mold shell 402 can move so that the first sub-mold shell 401 and the second sub-mold shell 402 can be switched between a separated state and a closed state. In the process of the first sub-mold shell 401 and the second sub-mold shell 402 moving from the closed state to the separated state, the first sub-mold shell 401 and the second sub-mold shell 402 move in directions away from each other. In the process of the first sub-mold shell 401 and the second sub-mold shell 402 moving from the separated state to the closed state, the first sub-mold shell 401 and the second sub-mold shell 402 move in directions toward each other to be closed.

A structure of the ice maker 1001 when the first sub-mold shell 401 and the second sub-mold shell 402 are in a closed state is shown in FIG. 5. A structure of the ice maker 1001 when the first sub-mold shell 401 and the second sub-mold shell 402 are in a separated state is shown in FIG. 6.

In some embodiments, the mold shell 400 includes a plurality of sub-mold shells (e.g., more than two). In this case, a movement mode and cooperative relationship between the plurality of sub-mold shells are similar to the first sub-mold shell 401 and the second sub-mold shell 402 in the above-mentioned mold shell 400, and it will not be repeated in the present disclosure.

In some embodiments, as shown in FIG. 4, the mold shell 400 includes a shell portion 200 and a mold portion 300, and the mold portion 300 is disposed in the shell portion 200. In some embodiments, the mold shell 400 includes only the mold portion 300 without including the shell portion 200.

In some embodiments, as shown in FIG. 4, the shell portion 200 includes a first shell portion 210 and a second shell portion 220 that are arranged opposite to each other. The first shell portion 210 and the second shell portion 220 are arranged opposite to each other in an MN direction shown in FIG. 4. The first shell portion 210 is located on the M side of the shell portion 200. The second shell portion 220 is located on the N side of the shell portion 200. The MN direction corresponds to a right-left direction of the shell portion 200.

The first shell portion 210 and the second shell portion 220 can be switched between the separated state and the closed state. When the first shell portion 210 and the second shell portion 220 are in the closed state, the first shell portion 210 and the second shell portion 220 are closed to define an inner cavity. The mold portion 300 is disposed in the inner cavity.

For example, a first inner cavity is defined on an inner wall of the side of the first shell portion 210 close to the second shell portion 220, and a second inner cavity is defined on an inner wall of the side of the second shell portion 220 close to the first shell portion 210. The second inner cavity is arranged opposite to the first inner cavity and has a similar structure to the first inner cavity. When the first shell portion 210 and the second shell portion 220 are in the closed state, the first inner cavity and the second inner cavity together form an inner cavity.

In some embodiments, referring to FIG. 3 and FIG. 4, the mold portion 300 includes a first mold portion 310 and a second mold portion 320.

The first mold portion 310 is connected to the first shell portion 210 and fixed relative to the first shell portion 210. As the first shell portion 210 moves, the first mold portion 310 can follow its movement. For example, the first mold portion 310 is disposed in the first inner cavity of the first shell portion 210. The first mold portion 310 includes a first mold cavity 331 (as shown in FIG. 4), and the first mold cavity 331 is located on a side of the first mold portion 310 facing the second mold portion 320.

The second mold portion 320 is connected to the second shell portion 220 and fixed relative to the second shell portion 220. As the second shell portion 220 moves, the second mold portion 320 can follow its movement. For example, the second mold portion 320 is disposed in the second inner cavity of the second shell portion 220. The second mold portion 320 includes a second mold cavity 332 (as shown in FIG. 4), and the second mold cavity 332 is located on a side of the second mold portion 320 facing the first mold portion 310.

The first mold portion 310 and the second mold portion 320 can be switched between the separated state and the closed state. When the first mold portion 310 and the second mold portion 320 are in the closed state, the first mold portion 310 and the second mold portion 320 enclose a mold cavity 330, which is composed of the first mold cavity 331 and the second mold cavity 332.

In some embodiments, a first coupling portion is provided at an edge of the first mold cavity 331 of the first mold portion 310, and a second coupling portion is provided at an edge of the second mold cavity 332 of the second mold portion 320. The second coupling portion is adapted to the first coupling portion, and the second coupling portion is configured to cooperate with the first coupling portion to seal the gap between the first mold portion 310 and the second mold portion 320 when the first mold portion 310 and the second mold portion 320 are in the closed state.

For example, one of the first coupling portion and the second coupling portion is a convex rib, and the other is a groove, with the groove adapting to the convex rib. In this way, the first coupling portion and the second coupling portion cooperate with each other, which is conducive to improving the mold fit between the first mold portion 310 and the second mold portion 320, improving an aesthetic appearance of the ice block, and effectively avoiding a situation where the ice block has an irregular shape due to a presence of a flange at a joint of the first mold portion 310 and the second mold portion 320, which affects the aesthetic appearance of the ice block.

In some embodiments, at least one of the first mold portion 310 and the second mold portion 320 is configured to deform under an external force. For example, the first mold portion 310 and the second mold portion 320 are silicone rubber parts.

Figure 7:
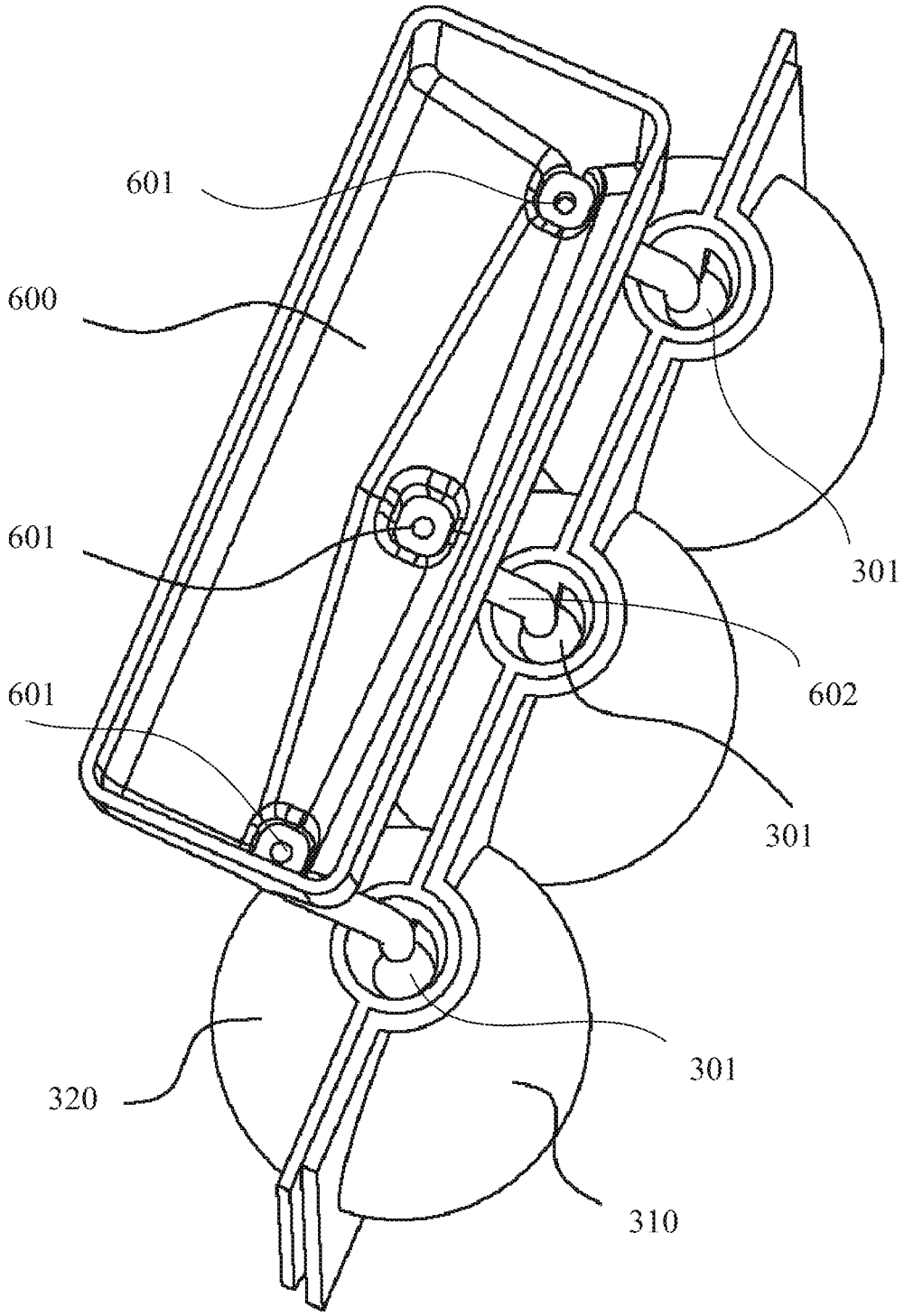
FIG. 7 is a perspective view of a water tank and a mold portion of an ice maker of a refrigerator according to some embodiments.

Referring to FIG. 3 and FIG. 7, the mold portion 300 further includes a water inlet 301, which is connected to the mold cavity 330. The upper side plate 101 has an opening 1011, which is provided at a position of the upper side plate 101 corresponding to the water inlet 301. A water injection tube can be connected to the water inlet 301 through the opening 1011, allowing water to be injected into the mold cavity 330. For example, the opening 1011 is formed as a rectangular through hole that penetrates the upper side plate 101 in a thickness direction.

In some embodiments, the mold portion 300 includes a plurality of mold cavities 330. For example, referring to FIG. 7, the mold portion 300 includes three mold cavities 330 and three water inlets, and each mold cavity 330 corresponds to a water inlet 301.

As shown in FIG. 7, the ice maker 1001 further includes a water tank 600. The water tank 600 is fixedly disposed on the base 100 and is located between the shell portion 200 and the upper side plate 101. A position of the water tank 600 corresponds to the opening 1011.

The water tank 600 includes a tank body 603, a plurality of water distribution tubes 602 and a plurality of water distribution ports 601. The plurality of water distribution ports 601 are formed on the tank body 603 and correspond to positions of the plurality of water inlets 301. The plurality of water distribution tubes 602 correspond to the plurality of water distribution ports 601. Two ends of any water distribution tube 602 are respectively connected to a corresponding water distribution port 601 and a corresponding water inlet 301.

It is understandable that when the mold portion 300 includes a plurality of mold cavities 330, a number of ice blocks produced in an ice making process of the ice maker 1001 can be increased. In addition, the water tank 600 with the water outlet 601 enhances the efficiency of water injection, thereby effectively improving an ice making efficiency.

In some embodiments, the mold portion 300 further includes at least one water hole. Any water hole is disposed between any two adjacent mold cavities 330 and is configured to be connected to any two adjacent mold cavities 330. For example, the mold portion 300 includes three mold cavities 330 and two water holes, and any two adjacent mold cavities 330 among the three mold cavities 330 are connected to each other by one of the two water holes, so that water injected into the mold cavities 330 can circulate in different mold cavities 330, which is conducive to averaging amount of water in the plurality of mold cavities 330, and to reducing a difference in the weight of ice blocks.

In some embodiments, the water inlet 301 is formed as a split structure. For example, as shown in FIG. 4, a top of the first mold portion 310 includes a first recess 311, and a top of the second mold portion 320 includes a second recess 321. When the first mold portion 310 and the second mold portion 320 are in the closed state, the first recess 311 and the second recess 321 are closed to form the water inlet 301.

It is understandable that in an ice making process of the ice maker 1001, the amount of water injected into the mold portion 300 is constant. Therefore, if there is leakage of ice making water from the water inlet 301 during water injection, the amount of water in the mold cavity 330 will decrease, and the weight of the ice block produced will be less than a preset weight of the ice block, resulting in reduced integrity of the ice block.

In some embodiments, the water inlet 301 is formed as an integrated structure. Referring to FIG. 7, the water inlet 301 is formed in a closed shape. For example, a structure defining the water inlet 301 is an annular structure (such as a funnel-shaped structure), and an inner side of the annular structure defines the water inlet 301. In this way, the water inlet 301 with the integrated structure prevents leakage of ice making water from the water inlet 301, which is conducive to improving the integrity of the ice block produced.

In some embodiments, the water inlet 301 is formed on the first mold portion 310 or the second mold portion 320.

It is understandable that if half of the water inlet 301 is located in the first mold portion 310 and the other half of the water inlet 301 is located in the second mold portion 320, when water leaks out of the mold cavity 330 from a joint of the first mold portion 310 and the second mold portion 320 of the water inlet 301 during water injection, the leaked water will cause mold adhesion after freezing. This will make it difficult to separate the first mold portion 310 and the second mold portion 320 during a subsequent demolding process, resulting in an unsmooth demolding process.

Therefore, by configuring the water inlet 301 to be integrally formed on the first mold portion 310 or the second mold portion 320, instead of being formed by closing two half-molds, it can be avoided that the ice making water leaks out of the mold cavity 330 from a mold closing line of the water inlet 301 during water injection, causing mold adhesion. As a result, this facilitates the efficiency of ice block demolding and improves the integrity of produced ice blocks.

In some embodiments, referring to FIG. 4, the first shell portion 210 includes a first groove 211, which is located on a side of the first shell portion 210 close to the second shell portion 220 and is located on the top of the first shell portion 210. The second shell portion 220 includes a second groove 221, which is located on a side of the second shell portion 220 close to the first shell portion 210 and is located on the top of the second shell portion 220. When the first shell portion 210 and the second shell portion 220 are in the closed state, the first groove 211 and the second groove 221 cooperatively form an avoidance opening 250 enclosed at a periphery of the water inlet 301. The water inlet 301 is located in the avoidance opening 250.

It is understandable that the refrigerator 1 in some embodiments of the present disclosure is provided with a water inlet 301 connected to the mold cavity 330 on the top of the mold portion 300. In this way, after the mold portion 300 is closed, the water inlet 301 is still connected to an outside, i.e., the water inlet 301 remains open. In addition, since the water inlet 301 is provided on the top of the mold portion 300, as long as a proper amount of water is preset, when the water freezes and expands, air within the mold cavity 330 can be released through the water inlet 301 without causing water to overflow from it. Therefore, the water inlet 301 provided on a top of the mold cavity 330 in the present disclosure not only facilitates water injection, but also solves the problem of water overflowing due to thermal expansion and contraction when water freezes.

In some embodiments, as shown in FIG. 4 to FIG. 6, the first sub-mold shell 401 includes a first shell portion 210 and a first mold portion 310. The second sub-mold shell 402 includes a second shell portion 220 and a second mold portion 320. The ice maker 1001 also includes a demolding mechanism, and the demolding mechanism includes a plurality of first ejecting rods 410 arranged corresponding to the plurality of mold cavities 330.

For example, when the first shell portion 210 and the second shell portion 220 are in the closed state, the plurality of first ejecting rods 410 are located on a side of the first shell portion 210 away from the second shell portion 220, and the plurality of first ejecting rods 410 are spaced apart from the first shell portion 210 by a first predefined distance D1 (as shown in FIG. 5). The first ejecting rods 410 are fixedly disposed on the left side plate 102.

A plurality of first through holes 213 are provided at positions of the first shell portion 210 corresponding to the plurality of first ejecting rods 410. The plurality of first through holes 213 match the plurality of first ejecting rods 410 and correspond to the plurality of first ejecting rods 410, respectively. As shown in FIG. 6, when the first shell portion 210 and the second shell portion 220 are in the separated state, the first ejecting rods 410 pass through the first through holes 213 and is in contact with the first mold portion 310.

In some embodiments, as shown in FIG. 4 to FIG. 6, the demolding mechanism further includes a plurality of second ejecting rods 420. For example, when the first shell portion 210 and the second shell portion 220 are in the closed state, the plurality of second ejecting rods 420 are located on a side of the second shell portion 220 away from the first shell portion 210, and the plurality of second ejecting rods 420 are spaced apart from the second shell portion 220 by a second predefined distance D2 (as shown in FIG. 5). The second ejecting rods 420 are fixedly disposed on the right side plate 103.

For example, a predefined distance includes a first predefined distance D1 and a second predefined distance D2.

A plurality of second through holes 222 are provided at positions of the second shell portion 220 corresponding to the plurality of second ejecting rods 420, and the plurality of second through holes 222 match the plurality of second ejecting rods 420 and correspond to the plurality of second ejecting rods 420, respectively. As shown in FIG. 6, when the first shell portion 210 and the second shell portion 220 are in the separated state, the second ejecting rods 420 pass through the second through holes 222 and are in contact with the second mold portion 320 (as shown in FIG. 4).

In some embodiments, referring to FIG. 4, an end surface of a side of the first ejecting rod 410 close to the first mold portion 310 matches a side surface of the first mold portion 310 away from the second mold portion 320, and an end surface of a side of the second ejecting rod 420 close to the second mold portion 320 matches a side surface of the second mold portion 320 away from the first mold portion 310. Thus, it is convenient for the first ejecting rod 410 to apply a force to the first mold portion 310 to effectively deform the first mold portion 310, and it is convenient for the second ejecting rod 420 to apply a force to the second mold portion 320 to effectively deform the second mold portion 320, thereby demolding the ice block in the first mold portion 310 and the second mold portion 320.

In some embodiments, the driving mechanism 500 is further configured to drive at least one of the first sub-mold shell 401 or the second sub-mold shell 402 to move. For example, the driving mechanism 500 is configured to drive at least one of the first shell portion 210 or the second shell portion 220 to move, so that the first shell portion 210 is separated from or closed with the second shell portion 220. The first mold portion 310 moves following the first shell portion 210, and/or the second mold portion 320 moves following the second shell portion 220.

It is understandable that, in an actual ice making process of the ice maker 1001, when the first shell portion 210 is separated from the second shell portion 220, the ice block may adhere to the first mold portion 310 or the second mold portion 320.

In some embodiments, as shown in FIG. 6, when the ice maker 1001 demolds the ice block, the driving mechanism 500 drives the first shell portion 210 to move to a first predetermined position. The first ejecting rod 410 passes through the first through hole 213 and pushes against the first mold portion 310, so that the first mold portion 310 is deformed by force, and the ice block in the first mold portion 310 is ejected. Meanwhile, the driving mechanism 500 drives the second shell portion 220 to move to a second predetermined position. The second ejecting rod 420 passes through the second through hole 222 and pushes against the second mold portion 320, so that the second mold portion 320 is deformed by force, and the ice block in the second mold portion 320 is ejected.

In other embodiments, when the ice maker 1001 demolds the ice block, the driving mechanism 500 drives one of the first shell portion 210 and the second shell portion 220 to move, so that the first ejecting rod 410 passes through the first through hole 213 and pushes against the first mold portion 310, or the second ejecting rod 420 passes through the second through hole 222 and pushes against the second mold portion 320, i.e., the demolding mechanism (including the first ejecting rod 410 and the second ejecting rod 420) passes through the through hole and pushes against the mold portion 300.

As configured above, the ice block in the first mold portion 310 or the second mold portion 320 can be effectively pushed out, so that the ice block falls into the ice storage box of the refrigerator 1 for users to take, thereby enhancing demolding effect of the produced ice block.

In some embodiments, the driving mechanism 500 is configured to drive the first sub-mold shell 401 to move, and the second sub-mold shell 402 is fixed. For example, the driving mechanism 500 is configured to drive the first shell portion 210 to move, so that the first shell portion 210 is separated from or closed with the fixed second shell portion 220. The first mold portion 310 moves following the first shell portion 210, and the second mold portion 320 is fixed relative to the second shell portion 220.

In some embodiments, the driving mechanism 500 controls opening and closing movements of the first shell portion 210 and the second shell portion 220 at the same time. The opening and closing movements of the first shell portion 210 and the second shell portion 220 include but are not limited to translation or rotation.

It should be noted that the translation refers to that one of the first shell portion 210 and the second shell portion 220 can perform translational motion relative to the other. The rotation refers to that one of the first shell portion 210 and the second shell portion 220 can perform rotational motion relative to the other.

It is understandable that, when the opening and closing movements of the first shell portion 210 and the second shell portion 220 are translation, the first shell portion 210 or the second shell portion 220 performs an opening and closing movement of translation through a translational driving system, i.e., any one of the sub-mold shells 401, 402 is driven to perform an opening and closing movement of translation through a translating rack or slide pin. In this way, positions of the shell portion 200 and the mold portion 300 before and after opening and closing can be fixed, avoiding position deviation caused by movement, and achieving a higher reliability. It is avoided that the two molds 300 are not tightly sealed and gaps are formed due to displacement of the positions before and after translation, causing water to leak out of the mold cavity 330 from the mold closing line of the water inlet 301 during water injection. It is also avoided that it is difficult for the ice block to be ejected during the demolding operation, affecting the regularity and beauty of the shape of the ice block.

In some embodiments, the ice maker 1001 includes two driving mechanisms 500 to respectively drive the first shell portion 210 and the second shell portion 220 to move. It is understood that a basic structure of the ice maker described above is only used as an example. In actual applications, corresponding components can be added or changed according to actual conditions, which is not limited in the present disclosure.

An ice making process of the refrigerator 1 is automated. Therefore, when the refrigerator 1 suddenly loses power, it is usually impossible to determine the state of the first mold portion 310 and the second mold portion 320 in the ice maker 1001 (including the closed state and the separated state), and it is also impossible to determine whether water exists in the mold cavity 330.

In some embodiments, the controller in the ice maker 1001 will assume that water exists in the mold cavity 330 by default, and after completing an ice making process, it will start normal water injection and subsequent ice making processes.

However, a volume of the mold cavity 330 defined by the first mold portion 310 and the second mold portion 320 is relatively large, so that a volume of the ice block produced is also relatively large. Therefore, the duration for the ice maker 1001 to complete the ice making process is relatively long. For example, the ice maker 1001 takes more than 20 hours to complete a process of producing transparent ice. In this case, when the refrigerator 1 is powered off and then powered back on during its operation, no water exists in the mold cavity 330, it would result in the ice maker 1001 failing to produce ice blocks normally, causing it to run continuously for over 20 hours. This results in increased energy consumption of the refrigerator 1 and increased production costs of ice blocks.

In some embodiments, the control device in the ice maker 1001 assumes that there is no water in the mold cavity 330 by default, and will inject water into the mold cavity 330 before performing the subsequent ice making process. Therefore, when the refrigerator 1 is powered off and then powered back on during its operation, if water exists in the mold cavity 330, it will cause overflow if water is injected again at this time, resulting in ice forming in the mold shell 400 and other components, and ice forming in the ice storage box.

In summary, when the refrigerator 1 is powered back on after being powered off during its operation, it is necessary to identify the state of the first mold portion 310 and the second mold portion 320, and determine whether water exists in the mold cavity 330 to determine whether water needs to be injected into the mold cavity 330.

For example, when the refrigerator 1 is powered off and then powered back on during its operation, the first mold portion 310 and the second mold portion 320 can be initialized, i.e., the first mold portion 310 and the second mold portion 320 are controlled to be closed and pressed together, thus placing the first mold portion 310 and the second mold portion 320 in an initial state. However, the above initialization operation may cause water in the mold cavity 330 to leak out, so it is necessary to first determine whether the mold cavity 330 is closed, and then perform the initialization operation on the first mold portion 310 and the second mold portion 320.

Figure 8:
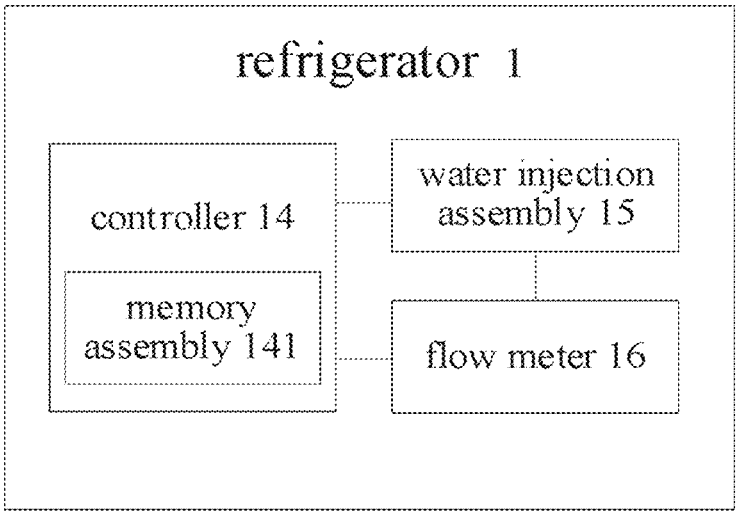
FIG. 8 is a block diagram of a refrigerator according to some embodiments.

Another refrigerator 1 is provided in some embodiments of the present disclosure, as shown in FIG. 8, which is different from the refrigerator 1 shown in FIG. 1 to FIG. 7 in that the refrigerator 1 shown in FIG. 8 further includes a controller 14 and a water injection assembly 15 (for example, including a water injection tube, etc.). The controller 14 is coupled to the ice maker 1001 and the water injection assembly 15. For example, the controller 14 is coupled to the driving mechanism 500 and the water injection assembly 15, and is configured to control the ice maker 1001 to complete the initialization operation, water injection operation, refrigeration operation, demolding operation, etc.

Figure 9:
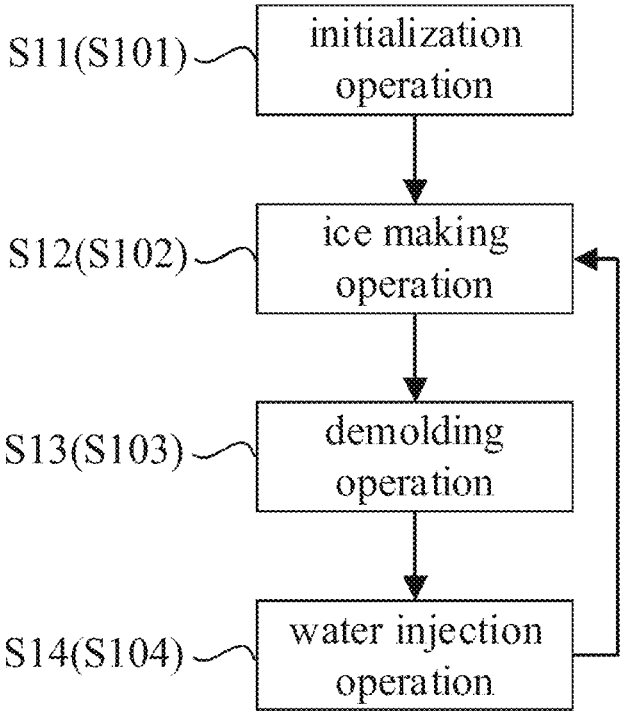
FIG. 9 is a flow chart of a method for controlling a refrigerator according to some embodiments.

As shown in FIG. 9, the controller 14 is configured to perform steps S11 to S14.

In the step S11, the ice maker 1001 is controlled to perform an initialization operation. The initialization operation includes controlling the driving mechanism 500 to drive the first mold portion 310 and the second mold portion 320 to open by a first preset number of steps X1, and then driving the first mold portion 310 and the second mold portion 320 to close.

For example, when the controller 14 performs an initialization operation, the controller 14 controls the driving mechanism 500 to drive the first shell portion 210 and the second shell portion 220 to move in a direction away from each other, so as to drive the first mold portion 310 and the second mold portion 320 to open by the first preset number of steps X1, and then the controller 14 controls the driving mechanism 500 to drive the first shell portion 210 and the second shell portion 220 to move in a direction close to each other, so as to drive the first mold portion 310 and the second mold portion 320 to close, i.e., the first mold portion 310 and the second mold portion 320 are in the closed state (i.e., a mold closing state).

In the step S12, the ice maker 1001 is controlled to perform an ice making operation. The ice making operation includes starting ice making in response to an ice making control instruction until the ice making is completed.

For example, after the controller 14 performs the initialization operation, a standby state is entered. In this case, when the user sends an ice making control instruction to the controller 14 through a preset human-computer interaction system such as a touch screen, a voice module, etc., the controller 14 responds to the ice making control instruction, controls a refrigeration system of the refrigerator 1 to perform cooling, and provide cold air to the ice making chamber to start ice making.

In this case, when the ice making time of the ice maker 1001 reaches a preset ice making time, the controller 14 controls the ice maker 1001 to stop making ice and continue to perform subsequent steps. Alternatively, the ice maker 1001 further includes a first temperature sensor, which is disposed on at least one of the first sub-mold shell 401 or the second sub-mold shell 402 and is configured to detect a temperature of the mold cavity 330. In this case, when the first temperature sensor detects that the temperature of the mold cavity 330 reaches a first preset temperature threshold, the controller 14 controls the ice maker 1001 to stop making ice and continue to perform subsequent steps.

It is understood that when the ice making time reaches the preset ice making time, it means that sufficient cold is delivered to the ice making chamber, so it can be determined that the water in the mold cavity 330 has condensed into ice. Alternatively, when the first temperature sensor detects that the temperature of the mold cavity 330 reaches the first preset temperature threshold, it can also be determined that the water in the mold cavity 330 has condensed into ice, which is conducive to improving the ice making efficiency.

In the step S13, the ice maker 1001 is controlled to perform a demolding operation. The demolding operation includes controlling the driving mechanism 500 to drive at least one of the first mold portion 310 or the second mold portion 320 to move toward at least one of corresponding first ejecting rod 410 or second ejecting rod 420, such that the ice block in the first mold portion 310 and the second mold portion 320 is ejected.

For example, when the controller 14 performs the ice making operation and the preset ice making time is reached, the controller 14 starts to perform the demolding operation. The controller 14 controls the driving mechanism 500 to drive (such as through at least one of the first shell portion 210 and the second shell portion 220) at least one of the first mold portion 310 or the second mold portion 320 to move toward at least one of the corresponding first ejecting rods 410 or second ejecting rods 420, so that at least one of the first ejecting rods 410 or the second ejecting rods 420 comes into contact with at least one of the first mold portion 310 or the second mold portion 320, causing it to deform and thereby causing the ice block therein to be ejected.

In the step S14, the ice maker 1001 is controlled to perform a water injection operation. The water injection operation includes controlling the driving mechanism 500 to drive the first mold portion 310 and the second mold portion 320 to close, and controlling the water injection assembly 15 to inject a preset amount of water into the mold cavity 330. Step S12 is then performed again.

For example, after the demolding operation is completed, the controller 14 controls the ice maker 1001 to perform a water injection operation. The controller 14 controls the driving mechanism 500 to drive (e.g., through the first shell portion 210 and the second shell portion 220) the first mold portion 310 and the second mold portion 320 to be closed, so that the first mold portion 310 and the second mold portion 320 remain in the mold closing state. The controller 14 controls the water injection assembly 15 to inject a preset amount of water into the mold cavity 330 to perform a next round of ice making cycle, i.e., the steps S12 to S14.

It should be noted that the preset amount of water may be a preset volume of water or a preset mass of water, which is not limited in the present disclosure.

In some embodiments, as shown in FIG. 8, the controller 14 includes a memory assembly 141. The memory assembly 141 is configured to record and store an operation currently performed by the ice maker 1001 when the refrigerator 1 is powered off. In other words, the refrigerator 1 has a power-off memory function. When the refrigerator 1 is powered off, the controller 14 writes the operation currently performed by the ice maker 1001 into the memory assembly 141. The currently performed operation includes an initialization operation, an ice making operation, a demolding operation, and a water injection operation. The refrigerator 1 also includes a flow meter 16, which is configured to record the amount of the injected water by the water injection assembly 15 (such as by recording pulses, etc.). It can be understood that the amount of the injected water can also be recorded in other ways, such as by recording a water injection time to determine the amount of the injected water.

For example, the memory assembly 141 includes, but is not limited to a magnetic storage device (e.g., a hard disk, a floppy disk or a tape, etc.), an optical disk (e.g., CD (Compact Disk), DVD (Digital Versatile Disk), etc.), a smart card and a flash memory device (e.g., an EPROM (Erasable Programmable Read-Only Memory), a card, a stick or a key drive, etc.).

In this way, when the refrigerator 1 is powered back on after being powered off, the controller 14 can read current state information of the ice maker 1001 when the refrigerator 1 is powered off, which is recorded in the memory assembly 141, and determine a state of the ice maker 1001 based on the current state information and information such as pulses of the flow meter 16 when the refrigerator 1 is powered back on.

In some embodiments, when the refrigerator 1 is powered off and then powered back on, on a condition that the controller 14 determines that no water exists in the mold cavity 330, the step S11 is performed to make the first mold portion 310 and the second mold portion 320 enter the initialization state, and the steps S12 to S14 are then performed, upon receiving an ice making control instruction, to complete an ice making process.

When the refrigerator 1 is powered off and then powered back on, on a condition that the controller 14 determines that water exists in the mold cavity 330, the controller 14 does not need to perform the step S11. In this case, the controller 14 can directly start performing the steps S12 to S14 upon receiving the ice making control instruction to complete an ice making process.

It can be understood that after the refrigerator 1 is powered back on and the controller 14 controls the ice maker 1001 to complete an ice making process, the user can send an ice making control instruction to the controller 14 again through the human-computer interaction system. In this case, the ice maker 1001 responds to the ice making control instruction and can directly perform the steps S12 to S14 to complete ice making without performing the step S11.

Figure 10:
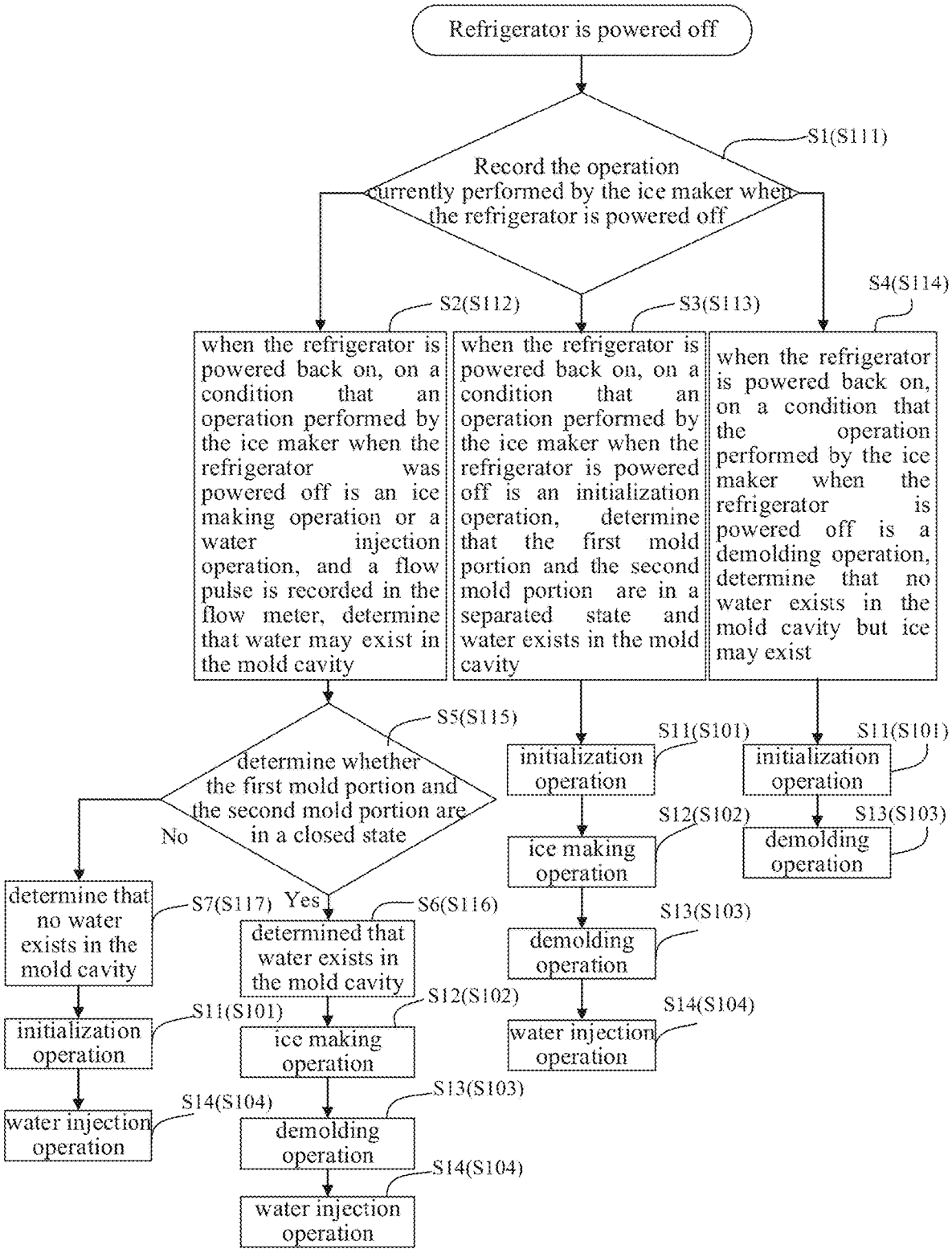
FIG. 10 is a flow chart of another method for controlling a refrigerator according to some embodiments.

In FIG. 10, the controller 14 is further configured to perform the steps S1 to S7. In the step S1, when the refrigerator 1 is powered off, the operation currently performed by the ice maker 1001 is recorded. When the operation currently performed by the ice maker 1001 is an ice making operation or a water injection operation, the step S2 is performed. When the operation currently performed by the ice maker 1001 is an initialization operation, the step S3 is performed. When the operation currently performed by the ice maker 1001 is a demolding operation, the step S4 is performed.

In the step S2, when the refrigerator 1 is powered back on, on a condition that an operation performed by the ice maker 1001 when the refrigerator 1 was powered off is an ice making operation or a water injection operation, and the flow meter 16 detects a flow pulse when the ice maker 1001 performs the water injection operation, it is determined that water may exist in the mold cavity 330, and the step S5 is performed.

In the step S3, when the refrigerator 1 is powered back on, on a condition that an operation performed by the ice maker 1001 when the refrigerator 1 was powered off is an initialization operation, it is determined that the first mold portion 310 and the second mold portion 320 are in a separated state and no water exists in the mold cavity 330, and the step S11 is performed.

It can be understood that on a condition that the operation performed by the ice maker 1001 when the refrigerator 1 was powered off is an initialization operation, the first mold portion 310 and the second mold portion 320 may be in a process of moving from the closed state to the separated state, or in a process of moving from the separated state to the closed state. However, no matter which of the above processes, the first mold portion 310 and the second mold portion 320 are separated, i.e., the first mold portion 310 and the second mold portion 320 are not closed, so the controller 14 can determine that no water exists in the mold cavity. In this case, the controller 14 needs to control the ice maker 1001 to perform the step S11 again to perform the initialization operation again.

In the step S4, when the refrigerator 1 is powered back on, on a condition that the operation performed by the ice maker 1001 when the refrigerator 1 was powered off is a demolding operation, it is determined that no water exists in the mold cavity 330 but ice may exist. The ice maker 1001 is controlled to perform the step S11 and then perform the step S13.

It is understandable that if the operation performed by the ice maker 1001 when the refrigerator 1 was powered off is a demolding operation, it is determined that no water exists in the mold cavity 330 when the refrigerator 1 is powered back on, but ice may exist or it is in an empty state. In this case, the controller 14 can assume that ice exists in the mold cavity 330 by default, and control the ice maker 1001 to perform the step S11 to drive the first mold portion 310 and the second mold portion 320 to move to a closed state. Step S12 is skipped then, and the controller 14 controls the ice maker 1001 to perform the step S13 to perform a demolding operation.

For example, after the controller 14 controls the ice maker 1001 to perform the step S13, it can further control the ice maker 1001 to perform the step S14, i.e., inject water into the mold cavity 330. In this way, after receiving the ice making control instruction sent by the user, it can immediately start to perform the step S12, i.e., the ice making operation.

In the step S5, it is determined whether the first mold portion 310 and the second mold portion 320 are in a closed state. If yes, the step S6 is performed, and if not, the step S7 is performed.

In the step S6, it is determined that water exists in the mold cavity 330, and the ice maker 1001 is controlled to perform the step S12.

It is understandable that when the controller 14 determines that the operation performed by the ice maker 1001 is an ice making operation or a water injection operation, a flow pulse is recorded in the flow meter 16, and the first mold portion 310 and the second mold portion 320 are in the closed state, it can be determined that water exists in the mold cavity 330. In this case, the controller 14 can control the ice maker 1001 to directly perform the step S12 to make ice.

For example, after the ice maker 1001 performs the step S12, the controller 14 is further configured to control the ice maker 1001 to perform the steps S13 and S14 to perform a demolding operation and a water injection operation. In this way, after receiving the ice making control instruction sent by the user, the step S12 can be immediately performed for the next round of ice making process.

In the step S7, it is determined that no water exists in the mold cavity 330, and the ice maker 1001 is controlled to perform the steps S11 and S14.

It is understandable that when the controller 14 determines that the first mold portion 310 and the second mold portion 320 are not in the closed state, it can be determined that no water exists in the mold cavity 330. In this case, the controller 14 controls the ice maker 1001 to first perform the step S11 to ensure that the first mold portion 310 and the second mold portion 320 are in the closed state. Then, without performing the steps S12 and S13, the controller 14 controls the ice maker 1001 to directly perform the step S14 to perform the water injection operation.

For example, after the ice maker 1001 completes the step S14, the controller 14 is further configured to control the ice maker 1001 to perform the steps S12 to S13 to complete the ice making process that was not completed by the ice maker 1001 before the refrigerator 1 is powered off.

It should be noted that, in the above steps, the determination of the state of the first mold portion 310 and the second mold portion 320 (such as in the steps S3 and S5, etc.) is made according to a position switch installed on the first mold portion 310 and the second mold portion 320 or by identifying current of a motor. In some embodiments, as shown in FIG. 5, the driving mechanism 500 includes a motor 510. The motor 510 is connected to at least one of the first shell portion 210 or the second shell portion 220, and is configured to drive at least one of the first shell portion 210 and the second shell portion 220 to move, thereby driving at least one of the first mold portion 310 or the second mold portion 320 to move. In a round of ice making process, the rotation speed of the motor 510 can be variable.

It should be noted that the rotation speed of the motor 510 is inversely proportional to an output torque, i.e., when the rotation speed of the motor 510 increases, the output torque decreases, and when the rotation speed of the motor 510 decreases, the output torque increases.

In some embodiments, during the initialization operation of the ice maker 1001, the rotation speed of the motor 510 is a first preset rotation speed V1. During the demolding operation of the ice maker 1001, the rotation speed of the motor 510 is a second preset rotation speed V2. The second preset rotation speed V2 is less than the first preset rotation speed V1, i.e., the torque output by the motor 510 during the demolding operation of the ice maker 1001 is greater than the torque output by the motor 510 during the initialization operation of the ice maker 1001.

It can be understood that the first preset rotation speed V1 and the second preset rotation speed V2 are values pre-calculated and set in the driving mechanism 500, which can be set and adjusted according to actual conditions such as a structural size of the ice maker 1001, which is not limited in the present disclosure.

Figure 11:
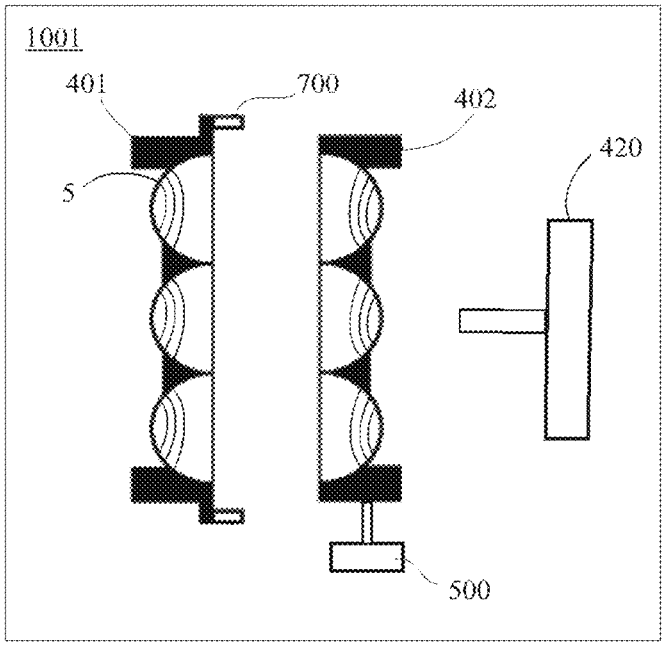
FIG. 11 is a diagram showing a structure of an ice maker of a refrigerator according to some embodiments.
Figure 12:
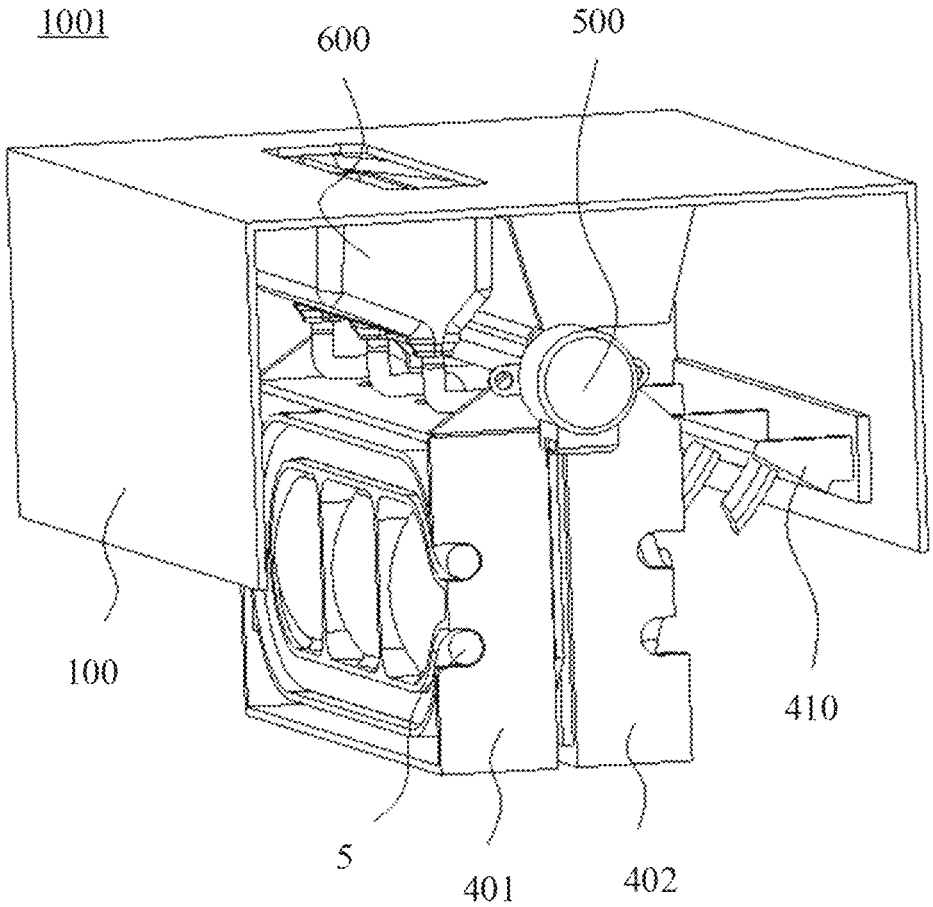
FIG. 12 is a perspective view of another ice maker of a refrigerator according to some embodiments.

In some embodiments, as shown in FIG. 11 and FIG. 12, the ice maker 1001 further includes a heating assembly 5, which is connected to at least one of the first mold portion 310 or the second mold portion 320 and is coupled to the controller 14. The controller 14 is also configured to control the heating assembly 5 to heat at least one of the first mold portion 310 or the second mold portion 320.

For example, the heating assembly 5 is a heating wire or a heating rod.

Figure 13:
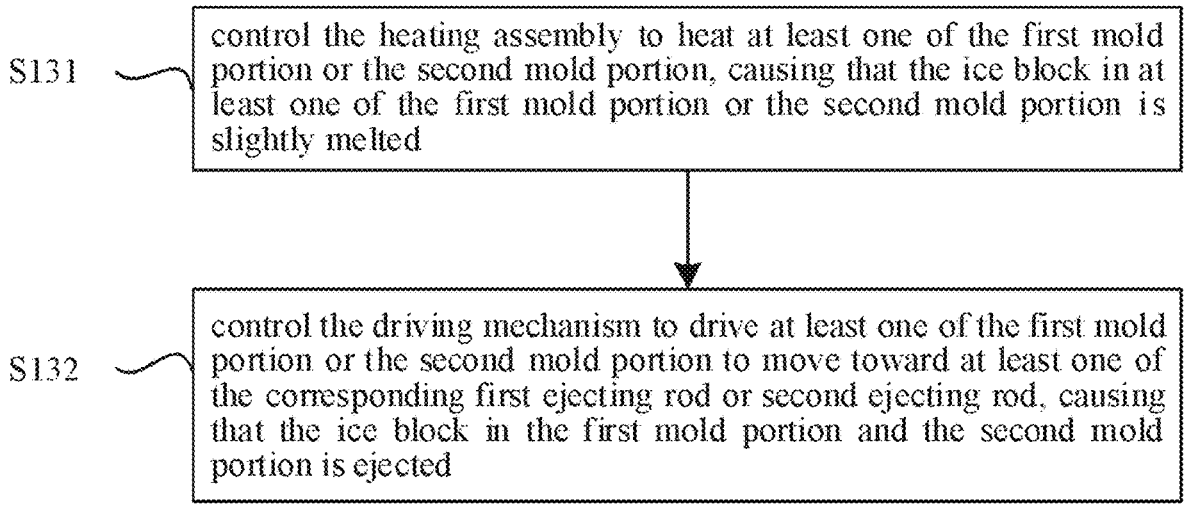
FIG. 13 is a flow chart of another method for controlling a refrigerator according to some embodiments.

In some embodiments, as shown in FIG. 13, the step S13 includes a step S131 and a step S132.

In the step S131, the heating assembly 5 is controlled to heat at least one of the first mold portion 310 or the second mold portion 320, causing that the ice block in at least one of the first mold portion 310 or the second mold portion 320 is slightly melted.

For example, the ice maker 1001 further includes a second temperature sensor, which is disposed on a side surface of the first mold portion 310 (i.e., the first sub-mold shell 401) away from the second mold portion 320 (i.e., the second sub-mold shell 402), and is configured to detect a surface temperature of the first mold portion 310. The controller 14 is coupled to the second temperature sensor, thereby realizing information exchange with the second temperature sensor to obtain the surface temperature of the first mold portion 310 detected by the second temperature sensor.

For example, after the ice making operation is completed, the controller 14 controls the heating assembly 5 to heat the first mold portion 310, and when the second temperature sensor detects that the surface temperature of the first mold portion 310 reaches a second preset temperature threshold T (i.e., a preset temperature threshold), the ice maker is controlled to perform the step S132. The second preset temperature threshold T is, for example, 5° C. to 6° C.

It is understandable that the second preset temperature threshold T can be set and adjusted according to actual conditions, which is not limited in the present disclosure.

For another example, after the ice making operation is completed, the controller 14 controls the heating assembly 5 to heat the first mold portion 310. When the heating time of the heating assembly 5 reaches a preset heating time, the ice maker 1001 is controlled to perform the step S132.

In the step S132, the driving mechanism 500 is controlled to drive at least one of the first mold portion 310 or the second mold portion 320 to move toward at least one of the corresponding first ejecting rod 410 or second ejecting rod 420, causing that the ice block in the first mold portion 310 and the second mold portion 320 is ejected.

It can be understood that before the controller 14 controls the driving mechanism 500 to drive the first mold portion 310 or the second mold portion 320 to open, it first controls the heating assembly 5 to heat at least one of the first mold portion 310 or the second mold portion 320, thereby facilitating the ice block to be ejected from the first mold portion 310 or the second mold portion 320.

In some embodiments, in the step S131, the controller 14 controls the heating assembly 5 to heat at least one of the first mold portion 310 or the second mold portion 320, and in the step S132, the controller 14 controls the heating assembly 5 to stop heating at least one of the first mold portion 310 or the second mold portion 320.

In other embodiments, in the step S131 and the step S132, the controller 14 controls the heating assembly 5 to heat at least one of the first mold portion 310 or the second mold portion 320. In this way, when at least one of the first mold portion 310 or the second mold portion 320 comes into contact with at least one of the corresponding first ejecting rods 410 or second ejecting rods 420, it facilitates ejection of the ice block from the first mold portion 310 or the second mold portion 320.

For example, when the controller 14 controls the driving mechanism 500 to drive at least one of the first mold portion 310 or the second mold portion 320 to move toward the corresponding at least one of the first ejecting rod 410 or the second ejecting rod 420 to reach a second preset number of steps X2, the controller 14 controls the heating assembly 5 to heat at least one of the first mold portion 310 or the second mold portion 320. The second preset number of steps X2 is less than a total number of steps X0 required for at least one of the first mold portion 310 or the second mold portion 320 to contact at least one of the first ejecting rod 410 or the second ejecting rod 420.

The following describes the movement process of the second sub-mold shell 402 in the above demolding operation by taking the example that the driving mechanism 500 only drives the second sub-mold shell 402 to move. It should be noted that in the above demolding operation, the movement process of the first sub-mold shell 401 and the second sub-mold shell 402 is similar, which will not be described in detail in this disclosure.

When the first sub-mold shell 401 and the second sub-mold shell 402 are in a closed state, the position of the second sub-mold shell 402 is considered as the initial position, and when the second sub-mold shell 402 presses the second ejecting rod 420, the position of the second sub-mold shell 402 is considered as a final position. Then, a number of steps required for the driving mechanism 500 to drive the second sub-mold shell 402 to move from the initial position to the final position is the total number of steps X0.

In this way, the controller 14 detects the number of movement steps of the second sub-mold shell 402 in real time, and a current movement position of the second sub-mold shell 402 can be obtained.

For example, when the controller 14 detects that a current number of movement steps of second sub-mold shell 402 reaches the total number of steps X0, it can be determined that the second sub-mold shell 402 is in contact with the second ejecting rod 420. In this case, the controller 14 controls the driving mechanism 500 to stop driving the second sub-mold shell 402 to move.

Similarly, in the process of the driving mechanism 500 driving the second sub-mold shell 402 to move, when the number of movement steps of the second sub-mold shell 402 reaches the second preset number of steps X2, the controller 14 controls the heating assembly 5 to heat the second sub-mold shell 402, so that a part of the ice block close to an inner surface of the second sub-mold shell 402 is melted, causing that the second ejecting rod 420 can eject the ice block from the mold cavity 330 to make the ice block fall into the ice storage box.

For example, $X2<X0$.

The number of steps required for the second mold shell 402 to move toward the second ejecting rod 420 to a position where the ice block can fall from a gap between the first mold shell 401 and the second mold shell 402 is preset as a third preset number of steps X3 (i.e., the number of demolding steps), and $X2>X3$.

It can be understood that the second preset number of steps X2, the third preset number of steps X3 and the total number of steps X0 are pre-calculated and set values, which can be set and adjusted according to the actual situation such as the structural size of the ice maker, which is not limited in the present disclosure.

Figure 14:
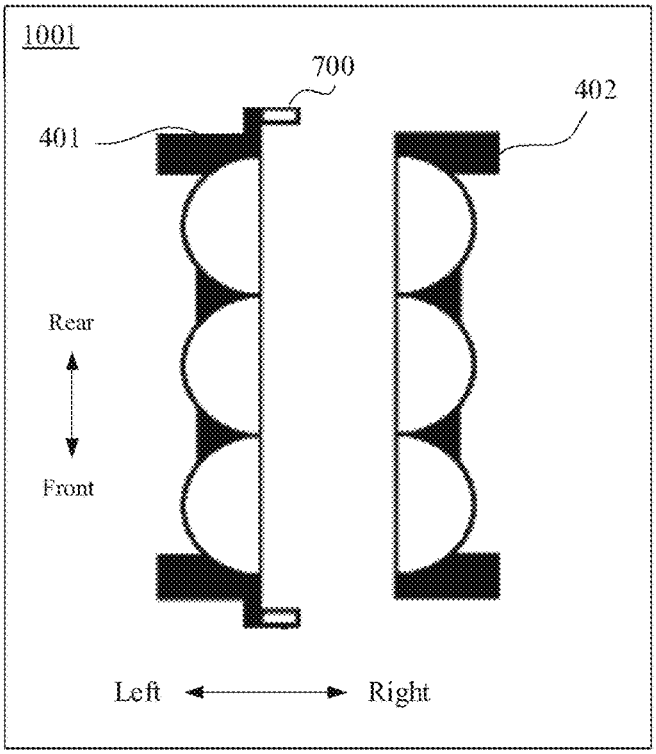
FIG. 14 is a diagram showing a structure of another ice maker of a refrigerator according to some embodiments.

In some embodiments, as shown in FIG. 11 and FIG. 14, the ice maker 1001 further includes at least one sensor device 700. The at least one sensor device 700 is connected to the mold shell 400. Along a length direction of the mold shell 400 (i.e., the front-rear direction as shown in FIG. 14), the at least one sensor device 700 is disposed on at least one side of the mold shell 400. A detection direction of the sensor device 700 is toward a plane where an opening of the first sub-mold shell 401 is located and a plane where an opening of the second sub-mold shell 402 is located. The sensor device 700 is configured to detect whether there is an ice block in the first sub-mold shell 401 or the second sub-mold shell 402 when the first sub-mold shell 401 and the second sub-mold shell 402 are separated.

For example, at least one sensor device 700 is disposed on a side of the first sub-mold shell 401 along a length direction of the first sub-mold shell 401, or at least one sensor device 700 is disposed on a side of the second sub-mold shell 402 along a length direction of the second sub-mold shell 402.

For example, the at least one sensor device 700 includes two sensor devices 700, and the two sensor devices 700 are disposed on a side of the first sub-mold shell 401 and on a side of the second sub-mold shell 402 along a length direction of the first sub-mold shell 401 and the second sub-mold shell 402, respectively.

It can be understood that when the sensor device 700 is running, the part of the ice block that protrudes from the plane where the opening of the first sub-mold shell 401 is located and the plane where the opening of the second sub-mold shell 402 is located is within a detection range of the sensor device 700. In this way, when the sensor device 700 detects existence of an obstacle within its detection range, it can be determined that there is an ice block in the first sub-mold shell 401 and/or the second sub-mold shell 402 that has not ejected.

Figure 15:
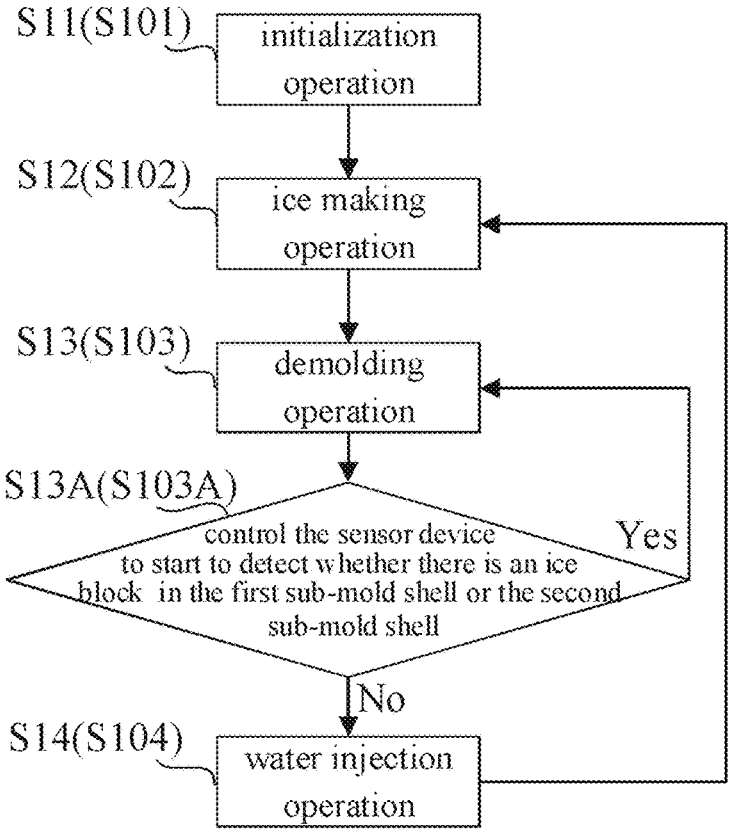
FIG. 15 is a flow chart of another method for controlling a refrigerator according to some embodiments.

As shown in FIG. 15, after the step S13 and before the step S14, the controller 14 is further configured to perform a step S13A.

In the step S13A, the sensor device 700 is controlled to start to detect whether there is an ice block in the first sub-mold shell 401 or the second sub-mold shell 402. If yes, the step S13 is re-performed, and if not, the step S14 is performed.

In some embodiments, after the step S132 and before the step S14, the controller 14 is further configured to perform a step S13A.

In the step S13A, the sensor device 700 is controlled to start to detect whether there is an ice block in the first sub-mold shell 401 or the second sub-mold shell 402. If yes, the step S131 is re-performed, and if not, the step S14 is performed.

In the refrigerator 1 provided by some embodiments of the present disclosure, a sensor device 700 is disposed in the ice maker 1001, which can directly and effectively detect whether the ice in the mold cavity 330 is successfully ejected after the ice maker 1001 completes the ice making operation and the demolding operation. Therefore, when the ice in the mold cavity 330 fails to be ejected, the controller 14 can control the ice maker 1001 to perform the demolding operation again to avoid water overflow due to demolding failure and freezing of various components in the ice maker 1001, thereby facilitating an operation stability of the ice maker 1001 and improving the user experience.

In some embodiments, as shown in FIG. 11 and FIG. 14, the sensor device 700 is disposed on a side of the first sub-mold shell 401. When the first sub-mold shell 401 and the second sub-mold shell 402 are in the closed state, the sensor device 700 is closer to the second sub-mold shell 402 than the plane where the opening of the first sub-mold shell 401 is located. In other words, when the first sub-mold shell 401 and the second sub-mold shell 402 are in a separated state, along an arrangement direction from the first sub-mold shell 401 to the second sub-mold shell 402 (i.e., the left-right direction shown in FIG. 14), the sensor device 700 is located between the first sub-mold shell 401 and the second sub-mold shell 402. The detection direction of the sensor device 700 is parallel to the plane where the opening of the first sub-mold shell 401 is located.

Figure 16:
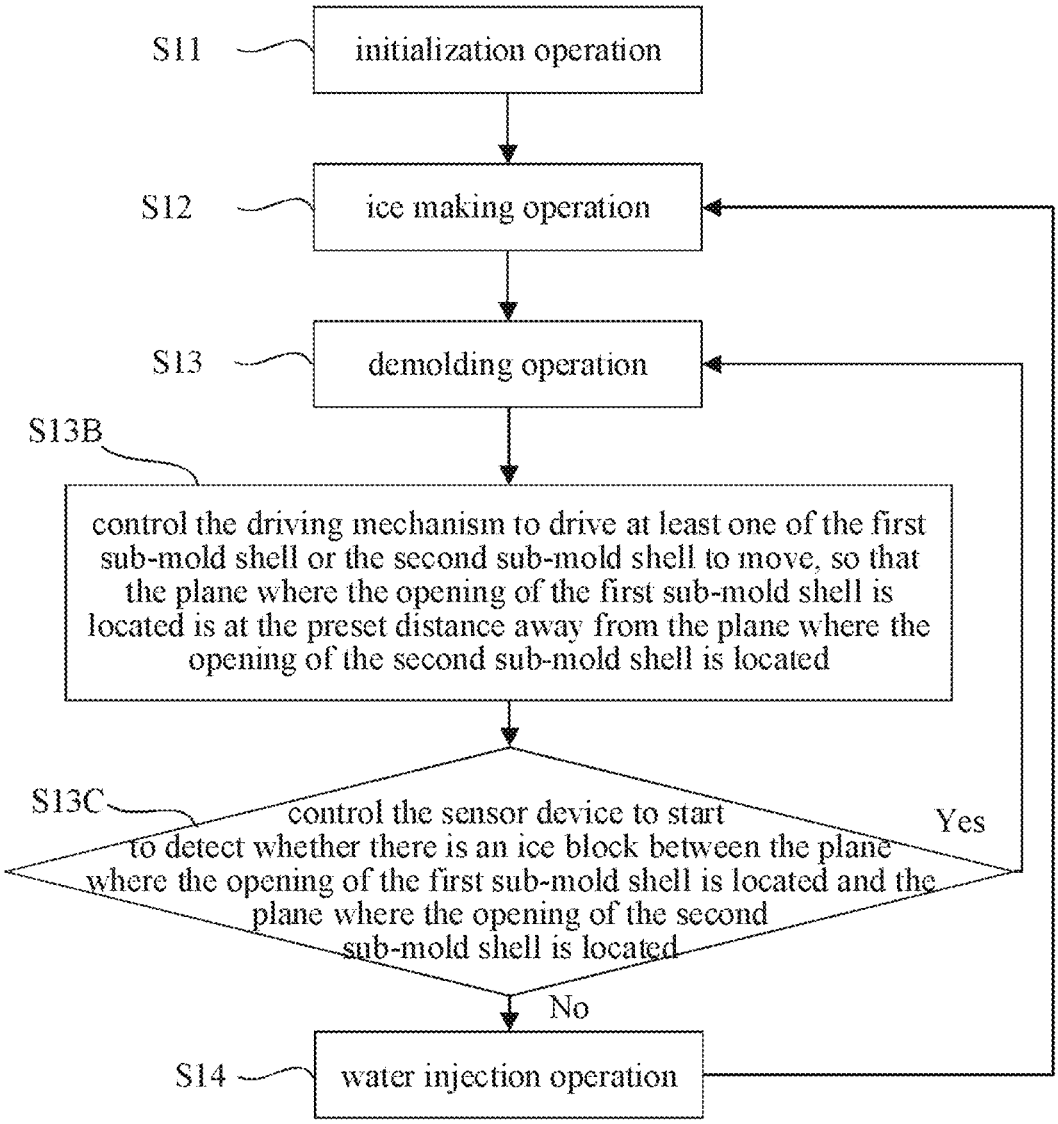
FIG. 16 is a flow chart of another method for controlling a refrigerator according to some embodiments.

Based on the above structure, as shown in FIG. 16, the step S13A includes a step S13B and a step S13C.

In the step S13B, the driving mechanism 500 is controlled to drive at least one of the first sub-mold shell 401 or the second sub-mold shell 402 to move, so that the plane where the opening of the first sub-mold shell 401 is located is at the preset distance away from the plane where the opening of the second sub-mold shell 402 is located.

For example, the preset distance is less than or equal to half of at least one of a width, height or depth of the mold cavity 330. In this way, the detection accuracy of the sensor device 700 is improved.

It can be understood that on a condition that the preset distance is greater than half of at least one of the width, height or depth of the mold cavity 330, when an ice block is in either the first sub-mold shell 401 or the second sub-mold shell 402, the sensor device 700 may not detect the ice block, resulting in a decrease in the accuracy of the detection.

In the step S13C, the sensor device 700 is controlled to start to detect whether there is an ice block between the plane where the opening of the first sub-mold shell 401 is located and the plane where the opening of the second sub-mold shell 402 is located. If yes, the step S13 is re-performed, and if not, the step S14 is performed.

It can be understood that in some embodiments of the present disclosure, the refrigerator 1 only requires the sensor device 700 to be arranged on a side of the first sub-mold shell 401, without the need to arrange the sensor device 700 on the second sub-mold shell 402. In this way, when the ice maker 1001 completes the demolding operation, the controller 14 controls the driving mechanism 500 to drive the first sub-mold shell 401 or the second sub-mold shell 402 to move, or drive the first sub-mold shell 401 and the second sub-mold shell 402 to move simultaneously, so that the plane where the opening of the first sub-mold shell 401 is located is at a preset distance from the plane where the opening of the second sub-mold shell 402 is located. The preset distance is set according to at least one of the width, height or depth of the mold cavity 330. In other words, the preset distance is set according to a radius of a formed ice block.

Figure 17:
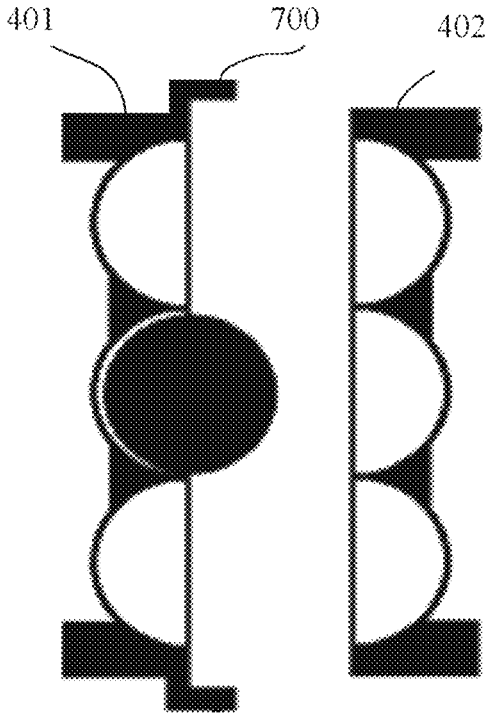
FIG. 17 is a diagram showing a structure of an ice maker of a refrigerator when there is an ice block in the first sub-mold shell according to some embodiments.
Figure 18:
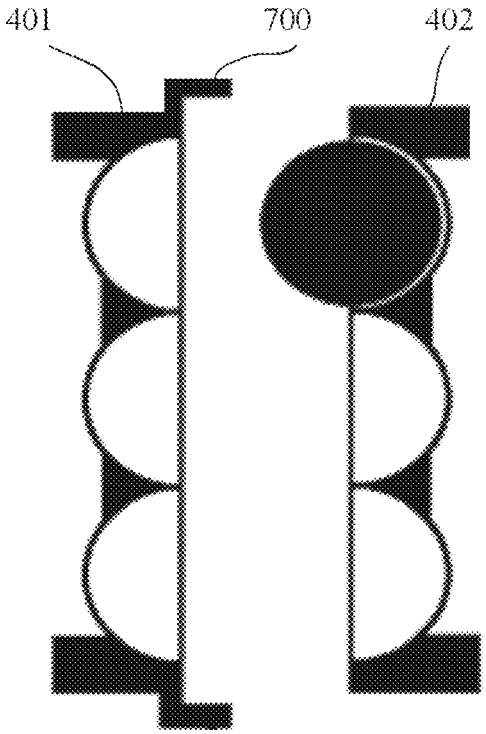
FIG. 18 is a diagram showing a structure of an ice maker of a refrigerator when there is an ice block in the second sub-mold shell according to some embodiments.

Therefore, referring to FIG. 17 and FIG. 18, when the first sub-mold shell 401 and the second sub-mold shell 402 are at a preset distance, the sensor device 700 is activated for detection, and at this time, whether the ice block is attached to the first sub-mold shell 401 (as shown in FIG. 17) or the second sub-mold shell 402 (as shown in FIG. 18), it can be detected by the sensor device 700 disposed on the side of the first sub-mold shell 401. In this way, the structure of the ice maker 1001 is effectively simplified, the circuit wiring is reduced, and the production cost is reduced.

In some embodiments, the mold shell 400 includes one or more mold cavities 330. The detection direction and method of the sensor device 700 can be adjusted according to the number and arrangement of the mold cavities 330.

Figure 19:
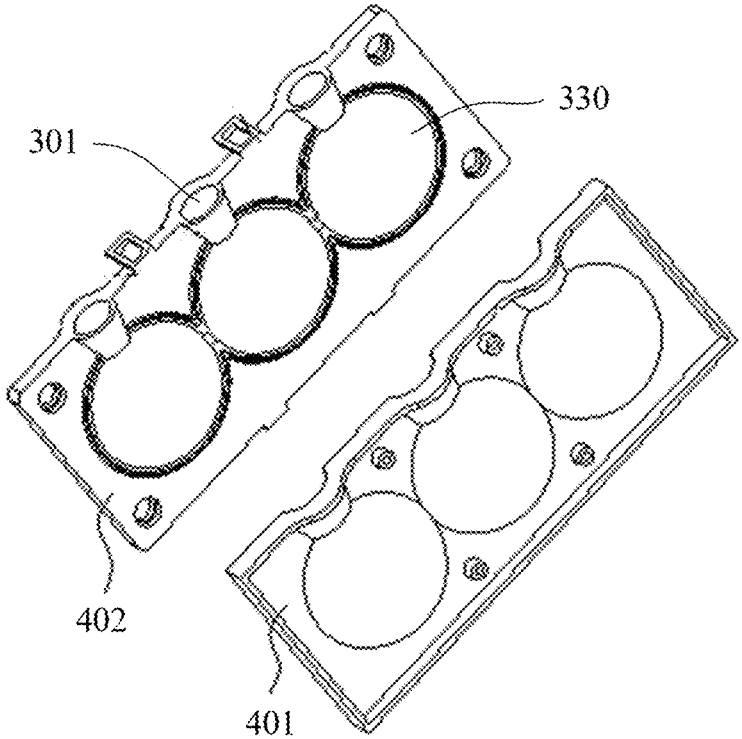
FIG. 19 is an exploded view of a mold shell of a refrigerator according to some embodiments.

For example, when the mold shell 400 includes one mold cavity 330, or the mold shell 400 includes a plurality of mold cavities 330 arranged along the detection direction of the sensor device 700, the detection direction of the sensor device 700 remains fixed. For example, as shown in FIG. 14 and FIG. 19, the mold shell 400 includes three mold cavities 330, and the three mold cavities 330 is arranged along the detection direction of the sensor device 700, so that the sensor device 700 can detect all three mold cavities 330 to detect whether there is an ice block in the three mold cavities 330.

For example, when the mold shell 400 includes a plurality of mold cavities 330, and the plurality of mold cavities 330 are not arranged along the detection direction of the sensor device 700, the detection direction of the sensor device 700 can rotate within a predetermined angle range in a direction parallel to the plane where the opening of the mold shell 400 is located, with a predetermined cycle. The predetermined angle range covers the area where the plurality of mold cavities 330 are located, so that the sensor device 700 can detect the plurality of mold cavities 330 to detect whether there is an ice block in the mold shell 400.

Figure 20:
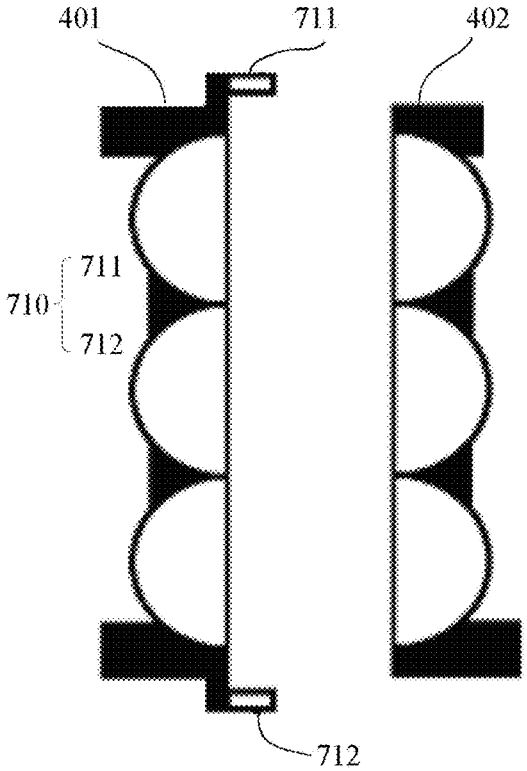
FIG. 20 is a diagram showing a structure of a mold shell of a refrigerator and a sensor device according to some embodiments.

In some embodiments, referring to FIG. 20, the sensor device 700 includes an infrared sensor 710. The infrared sensor 710 includes an infrared transmitting end 711 and an infrared receiving end 712, the infrared transmitting end 711 is arranged on a side of the first sub-mold shell 401 or the second sub-mold shell 402, and the infrared receiving end 712 is arranged on the other side of the same sub-mold shell.

For example, the infrared transmitting end 711 is disposed on a side of the first sub-mold shell 401 along the length direction of the first sub-mold shell 401, and the infrared receiving end 712 is disposed on the other side of the first sub-mold shell 401 along the length direction of the first sub-mold shell 401.

When the infrared sensor 710 is in operation, the infrared transmitting end 711 emits an infrared signal in the detection direction. In this case, on a condition that an ice block is in the first sub-mold shell 401 and/or the second sub-mold shell 402, propagation of the infrared signal will be blocked by the ice block, and the infrared receiving end 712 cannot receive the infrared signal.

On a condition that no ice block is in the first sub-mold shell 401 and the second sub-mold shell 402, the infrared receiving end 712 can receive the infrared signal. Based on this, depending on whether the infrared receiving end 712 receives the infrared signal emitted by the infrared transmitting end 711, it can be determined whether there is an ice block in the mold 400.

Figure 21:
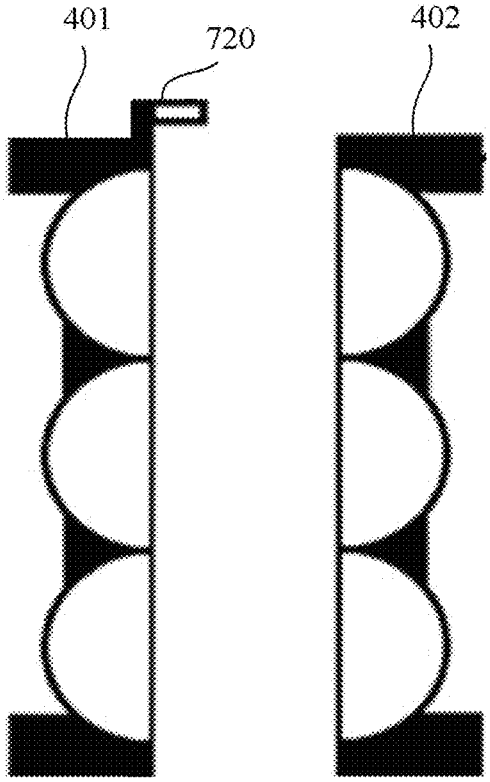
FIG. 21 is a diagram showing a structure of a mold shell of a refrigerator and another sensor device according to some embodiments.

In some embodiments, referring to FIG. 21, the sensor device 700 includes a radar sensor 720. The radar sensor 720 is disposed on a side of the first sub-mold shell 401 or the second sub-mold shell 402.

For example, the radar sensor 720 is disposed on a side of the first sub-mold shell 401 along the length direction of the first sub-mold shell 401.

It is understandable that the radar sensor 720 can detect objects by emitting microwaves, sound waves or lasers and receiving echoes. When the radar sensor 720 is in operation, it will emit microwaves, sound waves or laser signals in the detection direction. If the radar sensor 720 receives an echo signal within a preset time, it indicates that there is an ice block in the first sub-mold shell 401 and/or the second sub-mold shell 402. Otherwise, it indicates that there is no ice block in the first sub-mold shell 401 and the second sub-mold shell 402.

In some embodiments, when the mold shell 400 includes a plurality of mold cavities 330, the radar sensor 720 is also configured to detect a distance between itself and the ice block when detecting presence of the ice block in the mold shell, so that the controller 14 can determine the position of the mold cavity 330 where the ice block is located based on the distance detected by the radar sensor 720.

In this case, the heating assembly 5 can heat the mold cavity 330 where the ice block is located. For example, the heating assembly includes heating wires, which are disposed in the mold shell 400 and correspond to the plurality of mold cavities 330, respectively. When the controller 14 determines that a mold cavity 330 among the plurality of mold cavities 330 needs to be heated, the corresponding heating wire can be controlled to be energized for operation. In this way, the energy consumption of the refrigerator 1 is reduced.

In some embodiments, the ice maker 1001 further includes a fault alarm device, which is coupled to the controller 14 and is configured to issue a fault alarm message under the control of the controller 14.

The controller 14 is further configured to perform a step S21 and a step S22.

In the step S21, a number of times the ice maker 1001 performs the demolding operation in a current ice making process is obtained.

In the step S22, when the number of times the ice maker 1001 performs the demolding operation reaches a preset number, the fault alarm device is controlled to send a fault alarm message.

It is understandable that when the sensor device 700 detects presence of the ice block in the first sub-mold shell 401 or the second sub-mold shell 402, the controller 14 controls the ice maker 1001 to perform the demolding operation again (i.e., the step S13). Therefore, when the number of times the ice maker 1001 continuously performs the demolding operation reaches a preset number, it means that the ice maker 1001 has a fault that cannot be eliminated by itself. In this case, the controller 14 controls the fault alarm device to issue a corresponding fault alarm message to remind the user that the ice maker 1001 has a fault. When receiving the fault alarm message, the user can ask a maintenance personnel to eliminate the fault, thereby ensuring the normal operation of the ice maker.

It should be noted that the refrigerator 1 described in any of the above embodiments is refrigerated by the refrigeration system to provide cold air to the storage compartment so that the storage compartment is maintained at a constant low temperature. The refrigeration system includes a compressor, a condenser, a drying filter, a capillary tube and an evaporator, and a refrigeration cycle of the refrigeration system includes a compression process, a condensation process, a throttling process and an evaporation process.

During the compression process, the refrigerator is powered on and the compressor starts working. The low-temperature, low-pressure refrigerant is sucked into the compressor, compressed into a high-temperature, high-pressure superheated gaseous refrigerant in a cylinder of the compressor, and then discharged into the condenser.

During the condensation process, the high-temperature, high-pressure gaseous refrigerant dissipates heat through the condenser with the temperature continuously dropping, and it is cooled to a saturated gaseous refrigerant at room temperature and high pressure. When the saturated gaseous refrigerant at room temperature and high pressure is further cooled to a saturated liquid refrigerant, the temperature of the refrigerant no longer drops. At this time, the temperature of the refrigerant is called a condensation temperature. The pressure of the refrigerant remains almost unchanged during the condensation process.

During the throttling process, the condensed saturated liquid refrigerant passes through a drying filter to remove moisture and impurities and then flows into the capillary tube, where it is throttled and depressurized to become a wet gaseous refrigerant at room temperature and low pressure.

During the evaporation process, the refrigerant enters the evaporator, absorbs heat, and vaporizes to reduce the temperature of the evaporator and its surroundings, and becomes a low-temperature, low-pressure gaseous refrigerant. The refrigerant coming out of the evaporator returns to the compressor again, and the above process is repeated to transfer heat in the refrigerator to air outside the refrigerator, thereby achieving refrigeration of the refrigerator 1.

According to various embodiments of the present disclosure, the operation of the ice maker currently performed is recorded when the refrigerator is powered off. When the refrigerator is powered back on, the operation performed when the refrigerator is powered off is analyzed. On a condition that the operation performed when the refrigerator is powered off is an ice making or water injection operation, and a flow pulse of injected water is detected during the injection process, it is determined that there may be water in the mold cavity. Whether water exists in the mold cavity is further determined based on the closure state of the sub-mold shells, and subsequent operations are performed accordingly. In some applications, after power restoration, a simulated ice making operation needs to be performed to address the issue of possible residual water in the mold cavity during the power outage. That is, before an actual ice making process begins, a simulated ice making cycle is used to clear residual water from the mold cavity. Therefore, compared to using a simulated ice making approach, the technical solution provided in the present disclosure allows for a quicker transition into the actual ice making process, saving the user's wait time.

Deriving from the above-described embodiments, some embodiments of the present disclosure also provide a refrigerator where the controller is configured to record the operation currently performed by the ice maker when the refrigerator is powered off, and when the refrigerator is powered back on, determine whether water exists in the mold cavity based on the recorded operation. For example, on a condition that the recorded operation when refrigerator is powered off is an ice making or water injection operation, it is determined that water exists in the mold cavity, and on a condition that the recorded operation is a demolding operation, it is determined that no water exists in the mold cavity.

In some embodiments, on a condition that the recorded operation is an ice making or water injection operation, a flow pulse of injected water is detected during the injection operation, and the first and second sub-mold shells are in a closed state, it is determined that water exists in the mold cavity. On a condition that the recorded operation is an ice making or water injection operation, and the first and second sub-mold shells are not in the closed state, it is determined that no water exists in the mold cavity.

By combining water flow detection during the injection operation with the closure state of the sub-mold shells, it further improves the accuracy of determining whether there is water in the mold cavity.

In some embodiments of the present disclosure, a method for controlling a refrigerator is further provided, which can be applied in the refrigerator described in any of the above-mentioned embodiments (i.e., corresponding to FIGS. 1-21).

In some embodiments, as shown in FIG. 9, the method includes steps S101 to S104.

In the step S101, an initialization operation is performed, which includes controlling the driving mechanism 500 to drive the first mold portion 310 and the second mold portion 320 to open by a preset number of steps, and then driving the first mold portion 310 and the second mold portion 320 to close.

In the step S102, an ice making operation is performed, which includes starting ice making in response to an ice making control instruction until a preset ice making time is reached.

In the step S103, a demolding operation is performed, which includes controlling the driving mechanism 500 to drive at least one of the first mold portion 310 or the second mold portion 320 to move toward at least one of the corresponding first ejecting rod 410 or second ejecting rod 420, such that the ice block in the first mold portion 310 and the second mold portion 320 is ejected.

In the step S104, a water injection operation is performed, which includes controlling the driving mechanism 500 to drive the first mold portion 310 and the second mold portion 320 to close, and controlling the water injection assembly 15 to inject a preset amount of water into the mold cavity 330. The step S102 is then performed again.

In some embodiments, as shown in FIG. 10, the method further includes steps S111 to S117.

In the step S111, when the refrigerator 1 is powered off, the operation currently performed by the ice maker 1001 is recorded. When the operation currently performed by the ice maker 1001 is an ice making operation or a water injection operation, the step S112 is performed. When the operation currently performed by the ice maker 1001 is an initialization operation, the step S113 is performed. When the operation currently performed by the ice maker 1001 is a demolding operation, the step S114 is performed.

In the step S112, when the refrigerator 1 is powered back on, on a condition that an operation performed by the ice maker 1001 when the refrigerator 1 was powered off is an ice making operation or a water injection operation, and a flow pulse is recorded in the flow meter 16, it is determined that water may exist in the mold cavity 330. The step S115 is then performed.

In the step S113, when the refrigerator 1 is powered back on, on a condition that an operation performed by the ice maker 1001 when the refrigerator 1 was powered off is an initialization operation, it is determined that the first mold portion 310 and the second mold portion 320 are in a separated state and no water exists in the mold cavity 330. The step S101 is then performed.

In the step S114, when the refrigerator 1 is powered back on, on a condition that the operation performed by the ice maker 1001 when the refrigerator 1 was powered off is a demolding operation, it is determined that no water exists in the mold cavity 330 but ice may exist. The ice maker 1001 is controlled to perform the step S101 and then perform the step S103.

In the step S115, it is determined whether the first mold portion 310 and the second mold portion 320 are in a closed state. If yes, the step S116 is performed, and if not, the step S117 is performed.

In the step S116, it is determined that water exists in the mold cavity 330, and the ice maker 1001 is controlled to perform the step S102.

In the step S117, it is determined that no water exists in the mold cavity 330, and the ice maker 1001 is controlled to perform the step S101 and the step S104.

In some embodiments, as shown in FIG. 15, after the step S103 and before the step $104, the controller 14 is further configured to perform a step S103A.

In the step S103A, the sensor device 700 is controlled to start to detect whether there is an ice block in the first sub-mold shell 401 or the second sub-mold shell 402. If yes, the step $103 is re-performed, and if not, the step S104 is performed.

Beneficial effects of the above-mentioned method for controlling a refrigerator are the same as the beneficial effects of the refrigerators described in some of the above-mentioned embodiments, and will not be repeated here.

Some embodiments of the present disclosure provide a computer-readable storage medium (e.g., a non-transitory computer-readable storage medium) on which computer program instructions are stored. When the computer program instructions are executed on the controller 14, the controller 14 performs the above-mentioned method for controlling a refrigerator.

For example, the above-mentioned computer-readable storage media may include, but are not limited to: a magnetic storage device (e.g., a hard disk, a floppy disk, or a magnetic tape, etc.), an optical disk (e.g., a CD (Compact Disk), a DVD (Digital Versatile Disk), etc.), a smart card, and a flash memory device (e.g., EPROM (Erasable Programmable Read-Only Memory), a card, a stick, or a key drive, etc.). The various computer-readable storage media described in the embodiments of the present disclosure may represent one or more devices and/or other machine-readable storage media for storing information. The term "machine-readable storage medium" may include, but is not limited to, wireless channels and various other media capable of storing, containing, and/or carrying instructions and/or data.

In some embodiments of the present disclosure, a computer program product is provided. The computer program product includes computer program instructions (the computer program instructions are, for example, stored on a non-transitory computer-readable storage medium), and when the computer program instructions are executed on a computer, the computer program instructions cause the computer to perform the method for controlling a refrigerator as described above.

In some embodiments of the present disclosure, a computer program is provided. When the computer program is executed on a computer, the computer program enables the computer to perform the control method for the refrigerator as described above.

The beneficial effects of the above-mentioned computer-readable storage medium, computer program product and computer program are the same as the beneficial effects of the method for controlling a refrigerator described in some of the above-mentioned embodiments, and will not be repeated here.

Those skilled in the art will appreciate that the disclosure scope of the present invention is not limited to the above specific embodiments, and certain elements of the embodiments may be modified and replaced without departing from the spirit of the present application. The scope of the present application is limited by the appended claims.

What is claimed is:

1. A refrigerator, comprising:

a refrigerator body comprising an ice making chamber defined therein; and an ice maker disposed in the ice making chamber and comprising:

a mold shell comprising a first sub-mold shell and a second sub-mold shell;

a driving mechanism configured to drive at least one of the first sub-mold shell or the second sub-mold shell to move, the first sub-mold shell and the second sub-mold shell cooperatively defining a mold cavity when the first sub-mold shell and the second sub-mold shell move to a closed state; and a demolding mechanism disposed on at least a side of the mold shell and spaced apart from the mold shell by a predefined distance, wherein the demolding mechanism is configured to eject an ice block in the mold shell when the demolding mechanism comes into contact with the mold shell; and a controller configured to:

when the refrigerator is powered off, record an operation currently performed by the ice maker;

when the refrigerator is powered back on, on a condition that a recorded operation of the ice maker is an ice making operation or a water injection operation, and a flow pulse of injected water is detected when the ice maker performs the water injection operation, determine that water may exist in the mold cavity;

on a condition that the first sub-mold shell and the second sub-mold shell are in the closed state, determine that water exists in the mold cavity; and on a condition that the first sub-mold shell and the second sub-mold shell are not in the closed state, determine that no water exists in the mold cavity.

2. The refrigerator according to claim 1, wherein the controller is further configured to:

on a condition that it is determined that water exists in the mold cavity, control the ice maker to perform the ice making operation;

on a condition that it is determined that no water exists in the mold cavity, control the ice maker to perform an initialization operation, the water injection operation, and the ice making operation;

the initialization operation including controlling the driving mechanism to drive the first sub-mold shell and the second sub-mold shell to open by a first preset number of steps, and then driving the first sub-mold shell and the second sub-mold shell to close;

the ice making operation includes starting ice making in response to an ice making control instruction until a preset ice making time is reached; and the water injection operation includes controlling the driving mechanism to drive the first sub-mold shell and the second sub-mold shell to close, and controlling a water injection assembly to inject a preset amount of water into the mold cavity.

3. The refrigerator according to claim 2, wherein the controller is further configured to perform a demolding operation after the ice making operation, the demolding operation including controlling the driving mechanism to drive the mold shell to move toward the demolding mechanism until the mold shell contacts the demolding mechanism, such that the ice block in the mold shell is ejected by the demolding mechanism;

the driving mechanism comprises a motor, and the motor is connected to the mold shell; and during the initialization operation of the ice maker, a rotation speed of the motor is a first preset rotation speed, during the demolding operation of the ice maker, the rotation speed of the motor is a second preset rotation speed, and the second preset rotation speed is less than the first preset rotation speed.

4. The refrigerator according to claim 2, wherein the controller is further configured to perform a demolding operation after the ice making operation, the demolding operation including controlling the driving mechanism to drive the mold shell to move toward the demolding mechanism until the mold shell contacts the demolding mechanism, such that the ice block in the mold shell is ejected by the demolding mechanism; and the ice maker further comprises a sensor device, a detection direction of the sensor device is toward a plane where an opening of the first sub-mold shell is located and a plane where an opening of the second sub-mold shell is located, and the sensor device is configured to detect whether there is the ice block in the first sub-mold shell or the second sub-mold shell when the first sub-mold shell and the second sub-mold shell are separated; and wherein after the demolding operation and before the water injection operation, the controller is further configured to:

determine whether there is the ice block in the first sub-mold shell or the second sub-mold shell through the sensor device; and when there is the ice block in at least one of the first sub-mold shell or the second sub-mold shell, control the ice maker to re-perform the demolding operation.

5. The refrigerator according to claim 4, wherein the sensor device is arranged on the first sub-mold shell along a length direction of the first sub-mold shell, and a detection direction of the sensor device is parallel to the plane where the opening of the first sub-mold shell is located;

wherein determining whether there is the ice block in the first sub-mold shell or the second sub-mold shell through the sensor device comprises:

controlling the driving mechanism to drive at least one of the first sub-mold shell or the second sub-mold shell to move, such that the plane where the opening of the first sub-mold shell is located is at a preset distance from the plane where the opening of the second sub-mold shell is located; and determining whether there is the ice block between the plane where the opening of the first sub-mold shell is located and the plane where the opening of the second sub-mold shell is located through the sensor device; and wherein the preset distance is less than or equal to half of at least one of a width, height or depth of the mold cavity.

6. The refrigerator according to claim 5, wherein the mold shell comprises a plurality of mold cavities, and an arrangement direction of the plurality of mold cavities is substantially parallel to a detection direction of the sensor device.

7. The refrigerator according to claim 6, wherein the sensor device comprises an infrared sensor, the infrared sensor comprises an infrared transmitting end and an infrared receiving end, the infrared transmitting end is arranged on a side of one of the first sub-mold shell and the second sub-mold shell, and the infrared receiving end is arranged on the other side of the one of first sub-mold shell and the second sub-mold shell.

8. The refrigerator according to claim 6, wherein the sensor device comprises a radar sensor, the radar sensor is configured to detect whether there is the ice block in the mold shell, and when there is the ice block in the mold shell, to detect a distance between the radar sensor and the ice block;

the ice maker further comprises a heating assembly connected to the mold shell and coupled to the controller; and when there is the ice block in at least one of the first sub-mold shell or the second sub-mold shell, before controlling the ice maker to re-perform the demolding operation, the controller is further configured to:

determine a position of the mold cavity where the ice block is located according to the distance between the radar sensor and the ice block detected by the radar sensor; and control the heating assembly to heat the mold cavity where the ice block is located.

9. The refrigerator according to claim 4, wherein the ice maker further comprises a heating assembly, and the heating assembly is respectively connected to the first sub-mold shell and the second sub-mold shell;

the demolding mechanism is disposed on a side of the second sub-mold shell away from the first sub-mold shell and is spaced apart from the second sub-mold shell by the predefined distance, and the demolding mechanism is configured to eject the ice block in the second sub-mold shell; and the driving mechanism is configured to drive the second sub-mold shell to move.

10. The refrigerator according to claim 9, wherein before the demolding operation, the controller is further configured to:

control the heating assembly to heat the first sub-mold shell; and when it is detected that a surface temperature of the first sub-mold shell reaches a preset temperature threshold, or when a heating time of the heating assembly reaches a preset heating time, control the ice maker to perform the demolding operation.

11. The refrigerator according to claim 10, wherein the controller is further configured to:

control the heating assembly to heat the second sub-mold shell when a number of movement steps of the second sub-mold shell reaches a second preset number of steps, in a process of the driving mechanism driving the second sub-mold shell to move toward the demolding mechanism; and the second preset number of steps is less than a total number of steps required for the second sub-mold shell to move to be in contact with the demolding mechanism.

12. The refrigerator according to claim 4, wherein the ice maker further comprises a fault alarm device, the fault alarm device is coupled to the controller and is configured to issue a fault alarm message under control of the controller; and the controller is further configured to:

obtain a number of times the ice maker performs the demolding operation in a current ice making process; and when the number of times the ice maker performs the demolding operation reaches a preset number, control the fault alarm device to issue the fault alarm message.

13. The refrigerator according to claim 1, further comprising a flow meter configured to detect the flow pulse of injected water when the ice maker performs the water injection operation.

14. A control method for a refrigerator, wherein the refrigerator comprises:

a refrigerator body comprising an ice making chamber defined therein; and an ice maker disposed in the ice making chamber and comprising:

a mold shell comprising a first sub-mold shell and a second sub-mold shell;

a driving mechanism configured to drive at least one of the first sub-mold shell or the second sub-mold shell to move, the first sub-mold shell and the second sub-mold shell cooperatively defining a mold cavity when the first sub-mold shell and the second sub-mold shell move to a closed state; and a demolding mechanism disposed on at least a side of the mold shell and spaced apart from the mold shell by a predefined distance, the demolding mechanism being configured to eject an ice block in the mold shell when the demolding mechanism comes into contact with the mold shell; and wherein the method comprises:

when the refrigerator is powered off, recording an operation currently performed by the ice maker;

when the refrigerator is powered back on, on a condition that a recorded operation of the ice maker is an ice making operation or a water injection operation, and a flow pulse of injected water is detected when the ice maker performs the water injection operation, determining that water may exist in the mold cavity;

on a condition that the first sub-mold shell and the second sub-mold shell are in the closed state, determining that water exists in the mold cavity; and on a condition that the first sub-mold shell and the second sub-mold shell are not in the closed state, determining that no water exists in the mold cavity.

15. The control method according to claim 14, further comprising:

on a condition that it is determined that water exists in the mold cavity, controlling the ice maker to perform the ice making operation; and on a condition that it is determined that no water exists in the mold cavity, controlling the ice maker to perform an initialization operation, the water injection operation, and the ice making operation;

wherein the initialization operation includes controlling the driving mechanism to drive the first sub-mold shell and the second sub-mold shell to open by a first preset number of steps, and then driving the first sub-mold shell and the second sub-mold shell to close;

the ice making operation includes starting ice making in response to an ice making control instruction until a preset ice making time is reached; and the water injection operation includes controlling the driving mechanism to drive the first sub-mold shell and the second sub-mold shell to close, and controlling a water injection assembly to inject a preset amount of water into the mold cavity.

16. The control method according to claim 15, further comprising:

performing a demolding operation after the ice making operation, the demolding operation including controlling the driving mechanism to drive the mold shell to move toward the demolding mechanism until the mold shell contacts the demolding mechanism, such that the ice block in the mold shell is ejected by the demolding mechanism;

wherein the ice maker further comprises a sensor device, the sensor device is arranged on a side of at least one of the first sub-mold shell or the second sub-mold shell along a length direction of the mold shell, a detection direction of the sensor device is toward a plane where an opening of the first sub-mold shell is located and a plane where an opening of the second sub-mold shell is located, and the sensor device is configured to detect whether there is the ice block in the first sub-mold shell or the second sub-mold shell when the first sub-mold shell and the second sub-mold shell are separated; and wherein after the demolding operation and before the water injection operation, the control method further comprises:

controlling the sensor device to start to detect whether there is the ice block in the first sub-mold shell or the second sub-mold shell;

when there is the ice block in at least one of the first sub-mold shell or the second sub-mold shell, controlling the ice maker to re-perform the demolding operation; and when there is no ice block in at least one of the first sub-mold shell or the second sub-mold shell, controlling the ice maker to perform the water injection operation.

17. A refrigerator, comprising:

a refrigerator body, comprising an ice making chamber defined therein;

an ice maker, disposed in the ice making chamber, and comprising:

a mold shell comprising a first sub-mold shell and a second sub-mold shell;

a driving mechanism configured to drive at least one of the first sub-mold shell or the second sub-mold shell to move, wherein the first and second sub-mold shells cooperatively define a mold cavity when the first and second sub-mold shells move to a closed state; and a demolding mechanism disposed on at least a side of the mold shell and spaced apart from the mold shell by a predefined distance, the demolding mechanism being configured to eject an ice block in the mold shell when the demolding mechanism comes into contact the mold shell;

a controller, configured to:

record an operation currently performed by the ice maker when the refrigerator is powered off; and when the refrigerator is powered back on, determine a water status of the mold cavity based on a recorded operation.

18. The refrigerator according to claim 17, wherein the controller is further configured to:

on a condition that the recorded operation of the ice maker is an ice making operation or a water injection operation, determine that water exists in the mold cavity.

19. The refrigerator according to claim 17, wherein the controller is further configured to:

on a condition that the recorded operation of the ice maker is an ice making operation or a water injection operation, a water flow is detected during the water injection operation, and the first sub-mold shell and the second sub-mold shell are in the closed state, determine that water exists in the mold cavity; and on a condition that the recorded operation of the ice maker is the ice making operation or the water injection operation and the first sub-mold shell and the second sub-mold shell are not in the closed state, determine that no water exists in the mold cavity.

20. The refrigerator according to claim 17, wherein the ice maker further comprises a sensor device having a detection direction being toward openings of the first sub-mold shell and the second sub-mold shell, the sensor device being configured to detect whether there is the ice block in the first sub-mold shell and the second sub-mold shell when the first sub-mold shell and the second sub-mold shell are in a separated state; and wherein, after a demolding operation and before a water injection operation, the controller is further configured to:

determine whether the ice block is present in the first sub-mold shell and the second sub-mold shell through the sensor device; and on a condition that there is the ice block in at least one of the first sub-mold shell or the second sub-mold shell, control the ice maker to re-perform the demolding operation.

* * * * *